US010766723B2

(12) United States Patent
Tsukijima et al.

(10) Patent No.: US 10,766,723 B2
(45) Date of Patent: Sep. 8, 2020

(54) IMAGE FORMING APPARATUS

(71) Applicant: CANON KABUSHIKI KAISHA, Tokyo (JP)

(72) Inventors: Hisashi Tsukijima, Toride (JP); Shimpei Hanayama, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/928,502

(22) Filed: Mar. 22, 2018

(65) Prior Publication Data

US 2018/0284682 A1 Oct. 4, 2018

(30) Foreign Application Priority Data

Mar. 29, 2017 (JP) ..... 2017-064227
Feb. 19, 2018 (JP) ..... 2018-026932

(51) Int. Cl.
*B65H 5/02* (2006.01)
*G03G 15/00* (2006.01)
*G03G 15/16* (2006.01)

(52) U.S. Cl.
CPC ..... *B65H 5/025* (2013.01); *G03G 15/1615* (2013.01); *G03G 15/6529* (2013.01); *B65H 2404/252* (2013.01); *B65H 2404/256* (2013.01); *B65H 2406/20* (2013.01); *B65H 2601/324* (2013.01)

(58) Field of Classification Search
CPC .... B65H 2404/2693; B65H 2301/4228; B65H 5/025; G03G 2215/1661
USPC ..... 399/121
See application file for complete search history.

(56) References Cited

U.S. PATENT DOCUMENTS 5,659,851 A 8/1997 Moe et al.
7,941,074 B2 * 5/2011 Nakagaki ..... G03G 15/161 399/121
7,986,903 B2 * 7/2011 Park ..... G03G 15/161 399/121
8,116,656 B2 * 2/2012 Furuya ..... G03G 15/161 399/101
9,042,779 B2 5/2015 Kogure et al.
9,164,433 B2 10/2015 Kudo
(Continued)

FOREIGN PATENT DOCUMENTS

JP 2001-520611 A 10/2001
JP 2013-171204 A 9/2013
JP 2014-178505 A 9/2014

*Primary Examiner* — Howard J Sanders
(74) *Attorney, Agent, or Firm* — Venable LLP

(57) ABSTRACT

An image forming apparatus includes a belt conveyance device that corrects leaning of an endless belt member, the belt conveyance device being detachably attachable to an apparatus body of the image forming apparatus; a first guiding portion that supports a first guided portion provided in a frame member supporting rotatably a first roller on which the belt member is laid under tension and guides the belt conveyance device being attached to or detached from the apparatus body; and a second guiding portion that supports a second guided portion provided in a steering unit supporting rotatably a second roller on which the belt member is laid under tension, releases the second guided portion at an attachment position of the belt conveyance device to the apparatus body, and guides the belt conveyance device being attached to or detached from the apparatus body.

7 Claims, 26 Drawing Sheets

(56) References Cited

U.S. PATENT DOCUMENTS

| | | | | |
|---|---|---|---|---|
| 2011/0200355 | A1* | 8/2011 | Mori | G03G 15/1685 399/110 |
| 2011/0318048 | A1* | 12/2011 | Yasumoto | G03G 15/161 399/101 |
| 2014/0186073 | A1* | 7/2014 | Ju | G03G 21/168 399/121 |

* cited by examiner

IMAGE FORMING APPARATUS

BACKGROUND OF THE INVENTION

Field of the Invention

The present invention relates to an image forming apparatus that includes a belt conveyance device in a detachably attachable manner.

Description of the Related Art

There is a generally known issue that a belt member laid under tension on a plurality of tension rollers and conveyed rotationally may lean to either end of the rollers at the time of rotary driving, depending on the accuracy of outer diameters of the rollers and the accuracy of alignment between the rollers. To solve this issue, for example, Japanese Translation of PCT International Application No. 2001-520611 and Japanese Patent Laid-Open No. 2014-178505 suggest an alignment method by which, at the occurrence of belt leaning, a steering roller as a steering member is tilted by an unbalanced force of friction with the belt to cancel out autonomously the belt-leaning speed (hereinafter, called autonomous steering method). In the belt conveyance devices described in these publications, a steering roller support member is tiltably arranged on a frame member that rotatably supports the tension rollers including a driving roller, so that both ends of the steering roller are rotatably held by the steering roller support member.

In addition, for example, Japanese Patent Laid-Open No. 2013-171204 discloses a configuration that a belt conveyance device is detachably attached to an apparatus through an opening on the side of an apparatus body. In this configuration, the belt conveyance device can be inserted and removed by guiding the belt width-direction ends of the belt conveyance device along opposed guide rails in the apparatus body.

However, in such a configuration as described in Japanese Patent Laid-Open No. 2013-171204 that the belt conveyance device is detachably attachable by guiding the belt width-direction ends along the opposed guide rails in the apparatus body, the steering roller and the steering roller support member sag under their own weights during insertion and removal. To insert and remove the belt conveyance device without interference with a structure located under the insertion and removal path of the belt conveyance device, the belt conveyance device needs to follow a path lifted upward for the sag or more. This increases the space needed for insertion and removal.

In particular, in the autonomous-steering belt conveyance device, the steering roller is longitudinally tilted to further increase the space necessary for insertion and removal in combination with the sagging.

SUMMARY OF THE INVENTION

It is thus desirable to achieve the autonomous tilt of the steering roller in a state of being attached to the apparatus body and prevent the sagging of the steering roller when being inserted into or removed from the apparatus body even in the tilted state, thereby to suppress increase in the space necessary for insertion and removal without interference with a structure located under the insertion and removal path.

To solve the foregoing issues, an image forming apparatus of the present invention includes an apparatus body; and a belt conveyance device that is detachably attached to the apparatus body, wherein the belt conveyance device has a first roller configured to support an endless belt member; a frame member that supports rotatably said first roller; a second roller configured to support an endless belt member; a steering unit that supports rotatably said second roller, the steering unit being supported to be tiltable with respect to the frame member around an axial line vertical to an axial line of the second roller; and a sliding member provided in a state where rotation is restricted at both end portions of the second roller. When the belt member moves to one axial end side of the second roller, the steering unit tilts with respect to the frame member in a direction that the belt moves to the other axial end side of the second roller by a force generated by contacting the belt and the sliding member. The apparatus further includes a first guiding portion that is provided in the apparatus body to support a first guided portion provided in the frame member and guide the belt conveyance device attached to or detached from the apparatus body; and a second guiding portion that is provided in the apparatus body to support a second guided poprtion provided in the steering unit, release the second guided portion at an attachment position of the belt conveyance device to the apparatus body, and guide the belt conveyance device attached to or detached from the apparatus body.

According to the present invention, the steering unit is tiltable at the attached position, and is guided together with the frame member by the guiding portion in the process of attachment or removal. This makes it possible to achieve the tilt of the steering unit, regulate the sagging of the steering unit, and suppress increase in the space necessary for insertion and removal without interference with a structure located under the insertion and removal path.

Further features of the present invention will become apparent from the following description of exemplary embodiments with reference to the attached drawings.

DESCRIPTION OF THE EMBODIMENTS

Exemplary embodiments of the present invention will be described below in detail with reference to the drawings. However, dimensions, materials, shapes, and relative arrangements of components described in relation to the embodiments are not intended to limit the scope of the invention to them unless otherwise specified.

EXAMPLE 1

(Image Forming Apparatus)

Figure 1:
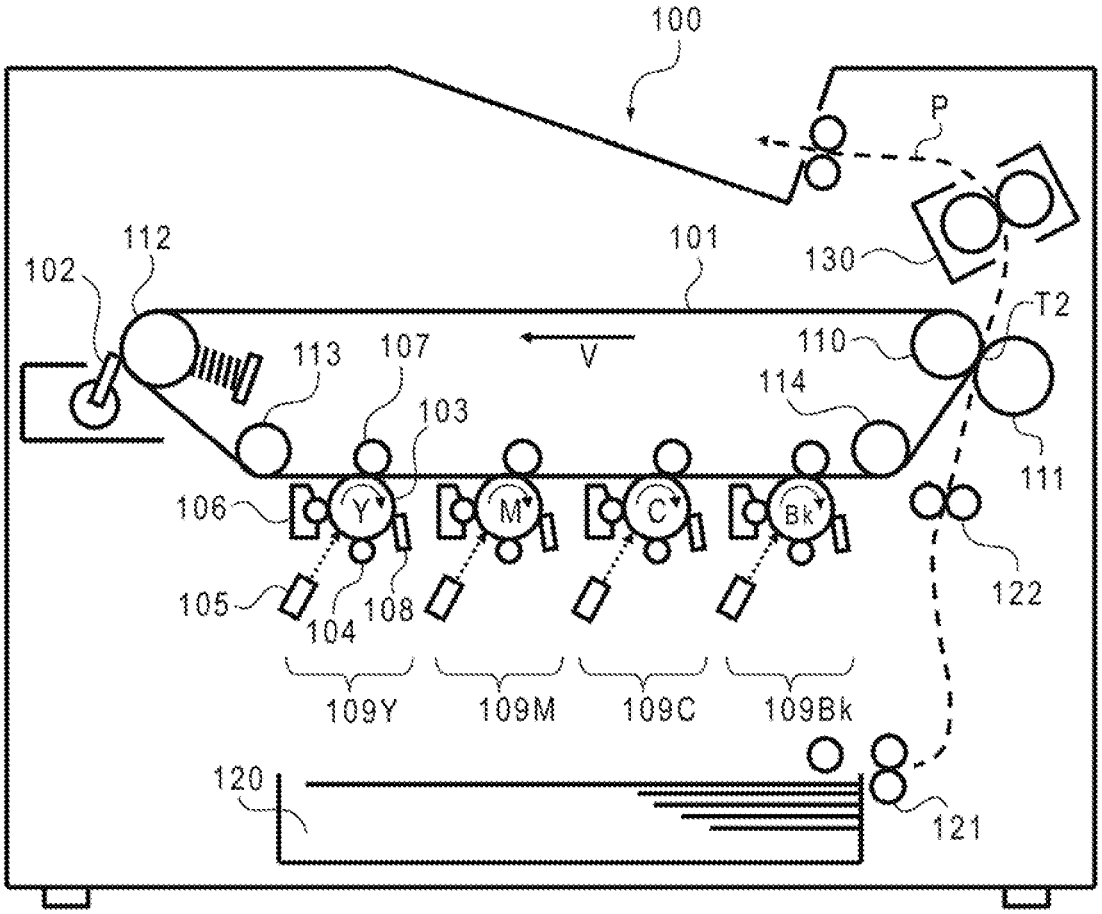
FIG. 1 is an illustrative diagram of a configuration of an image forming apparatus.

FIG. 1 is an illustrative diagram of an image forming apparatus. As illustrated in FIG. 1, an image forming apparatus 100 is an intermediate transfer-system tandem color digital printer including four image forming portions 109 along an intermediate transfer belt 101.

Four photosensitive drums 103 as image bearing members have surfaces charged with even electric charge by charging rollers 104. Laser scanners 105 accept the input of image signals of yellow, magenta, cyan, and black, and irradiate the drum surfaces with laser light according to the image signals to neutralize the electric charge and form latent images. The latent images on the drums are developed by development devices 106 with toners of yellow, magenta, cyan, and black. The developed toner images on the drums are primarily transferred by primary transfer rollers 107 in sequence onto the intermediate transfer belt 101, thereby to forming a full-color toner image on the surface of the intermediate transfer belt 101. The transfer residual toners on the photosensitive drums 103 are collected by drum cleaners 108.

Meanwhile, a transfer material P such as a paper sheet is fed by a sheet feeding roller 121 from a cassette feeding portion 120 to a registration roller 122, and further sent to a secondary transfer portion T2 in synchronization with the toner image on the intermediate transfer belt. The toner image on the intermediate transfer belt is transferred to the transfer material P by a secondary transfer inner roller 110 and a secondary transfer outer roller 111 in the secondary transfer portion T2, and then sent to a fuser 130. When the transfer material P is sent to the fuser 130, the toner image is fused into the transfer material P by heat and pressure in the fuser 130, and is ejected to the outside of the device. The transfer residual toner on the intermediate transfer belt 101 having not been transferred in the secondary transfer portion T2 is collected by an intermediate transfer belt cleaner 102.

(Intermediate Transfer Unit)

Figure 2A:
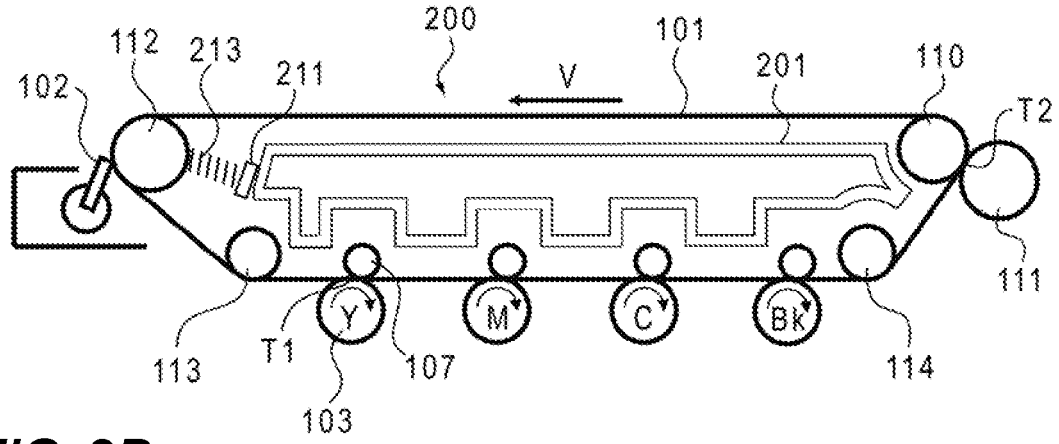
FIGS. 2A, 2B, and 2C are illustrative diagrams of an intermediate transfer unit.
Figure 2B:
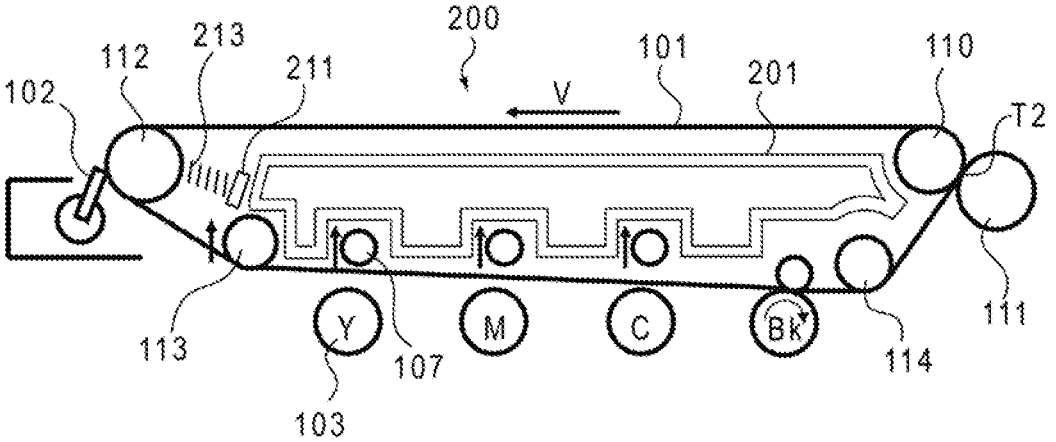
Figure 2C:
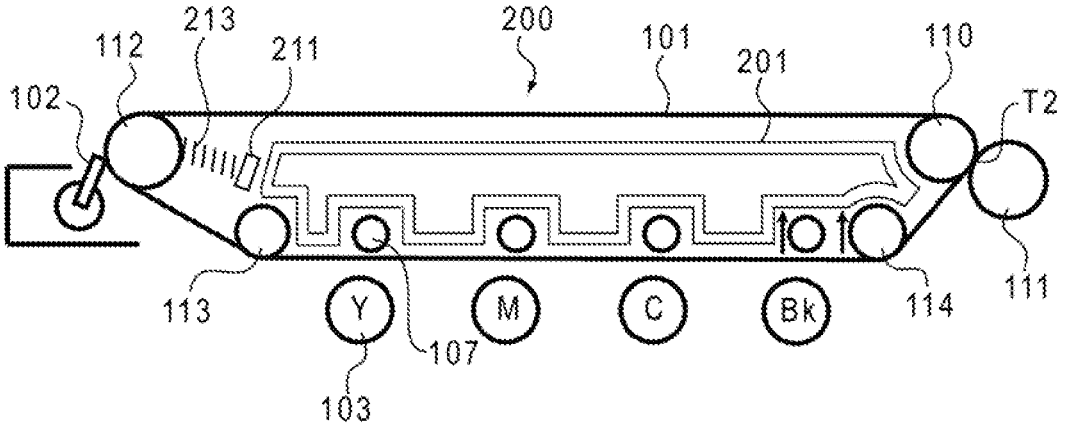

FIGS. 2A to 2C are illustrative diagrams of an intermediate transfer unit. An intermediate transfer unit 200 is a belt conveyance device having the intermediate transfer belt 101 that is laid under tension on a plurality of tension rollers and rotationally conveyed. The intermediate transfer belt 101 is an endless belt member made of polyimide or the like. The intermediate transfer belt 101 is laid under tension on a driving roller 110, a steering roller 112, tension rollers 113 and 114, and the primary transfer rollers 107 rotatably supported by part of the frame 201. These components are integrally assembled into the intermediate transfer unit 200. The driving roller 110 as a first roller also acts as secondary transfer inner roller constituting the secondary transfer portion T2. The steering roller 112 as a second roller also acts as a tension roller that is biased by a compression spring 213 to pressurize the intermediate transfer belt 101 from the inner side to apply tensile force to the intermediate transfer belt 101.

As illustrated in FIG. 2A, the primary transfer rollers 107 constitute primary transfer units T1 together with the photosensitive drums 103 via the intermediate transfer belt 101, and transfer toner images of yellow, magenta, cyan, and black in an overlapping manner on the intermediate transfer belt 101 to form a color image. Meanwhile, at the formation of a monochrome image, an up-and-down mechanism (not illustrated) separates the primary transfer rollers of yellow, magenta, and cyan, the intermediate transfer belt 101, and the photosensitive drums as illustrated in FIG. 2B to stop the photosensitive drums of yellow, magenta, and cyan. Then, a monochrome toner image is formed on the intermediate transfer belt 101 by the primary transfer roller and the photosensitive drum of black constituting the primary transfer portion T1 via the intermediate transfer belt 101. When the image forming apparatus is in the standby state, the primary transfer roller of black and the tension roller 114 are also moved to separate completely the intermediate transfer belt 101 from the four photosensitive drums 103 as illustrated in FIG. 2C.

(Autonomous Steering Mechanism)

Figure 3:
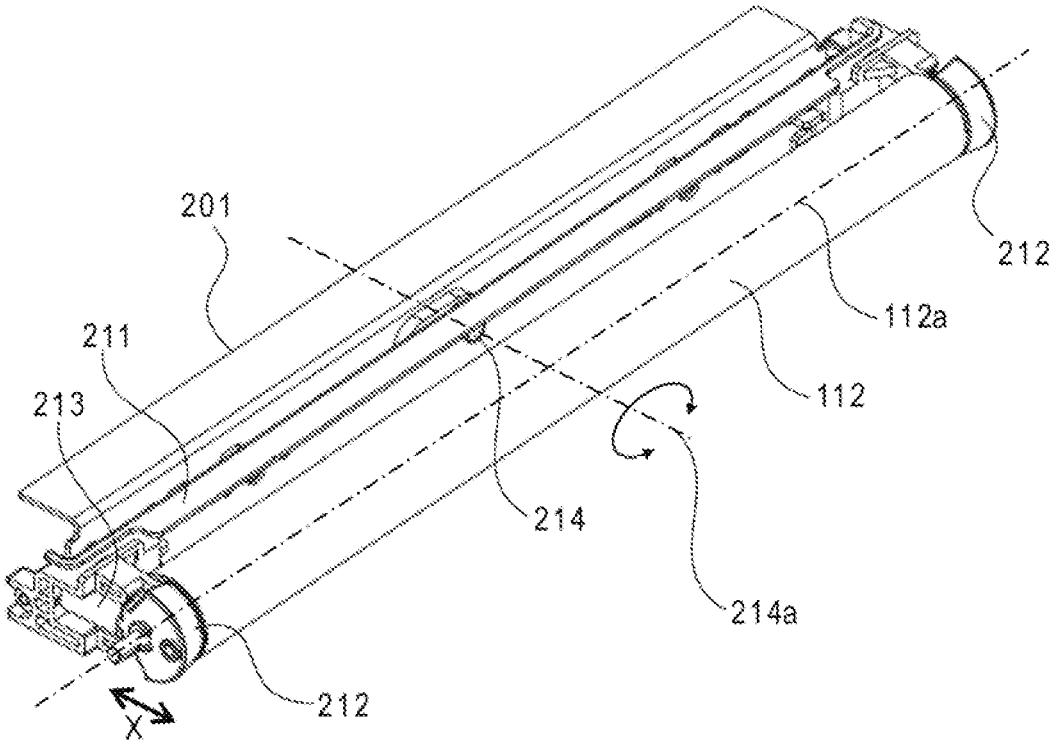
FIG. 3 is a perspective view of an autonomous steering mechanism.
Figure 4A:
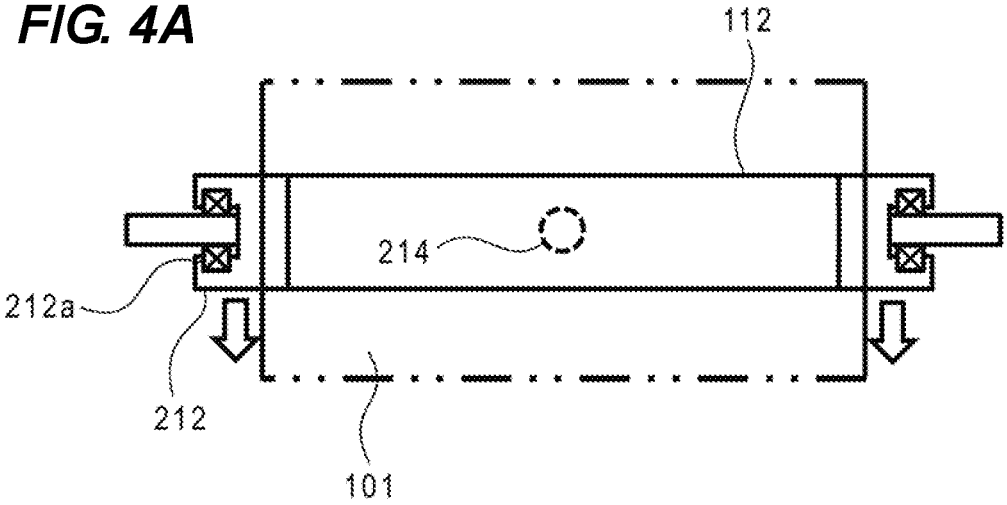
FIGS. 4A, 4B, and 4C are illustrative diagrams describing operations of the autonomous steering mechanism.
Figure 4B:
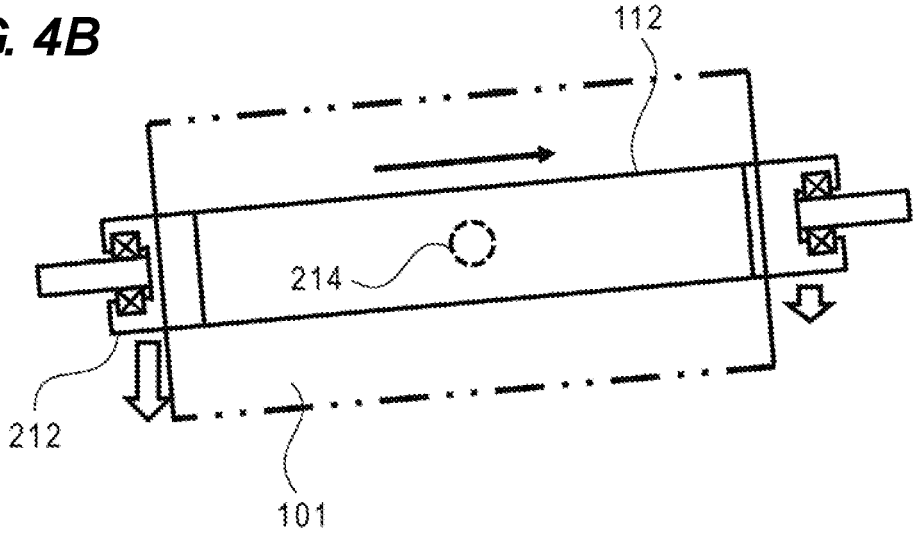
Figure 4C:
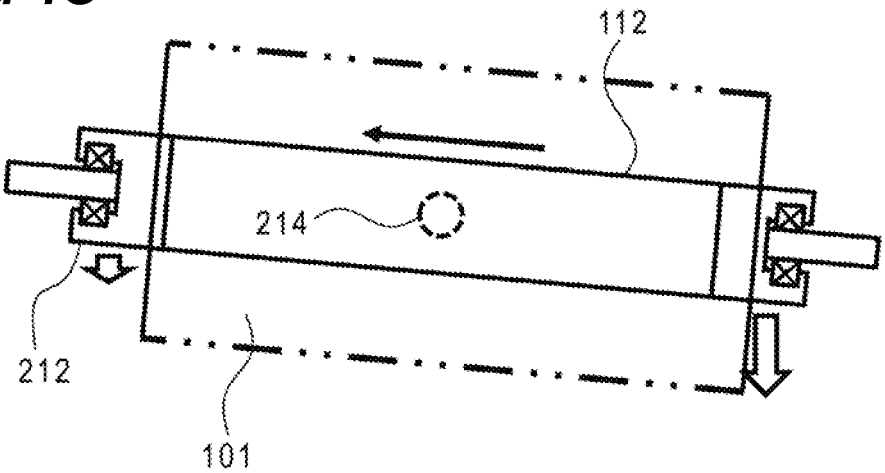

FIG. 3 is a perspective view of an autonomous steering mechanism, and FIGS. 4A to 4C are illustrative diagrams of operations of the autonomous steering mechanism.

The steering roller 112 has both ends supported by a steering roller support member 211 constituting the steering unit so that the steering roller 112 is rotated along with the rotation of the intermediate transfer belt 101. The steering roller 112 has slide ring portions 212 regulated in rotation at the both end portions. In Example 1, the slide ring portions 212 contain bearings 212*a* and also act as sliding members for the steering roller 112. The slide ring portions (sliding members) 212 are supported to be slidable with respect to the steering roller support member 211 in the directions of arrow X such that the steering roller 112 is biased by the compression spring 213 toward the intermediate transfer belt 101. The slide ring portions 212 are provided at the axial end portions of the steering roller 112. The steering roller support member 211 is supported via a rotation shaft 214 in such a manner to be tiltable with respect to the frame 201. The rotation shaft 214 is supported such that the steering roller support member 211 constituting the steering unit is tiltable with respect to the frame 201 as a frame member around an axial line 214*a* vertical to an axial line 112*a* of the steering roller 112.

When the intermediate transfer belt 101 laid under tension in balance with respect to the axial center of the steering roller 112 as illustrated in FIG. 4A leans to the left side (one axial side) as illustrated in FIG. 4B, a friction force occurs between the intermediate transfer belt 101 and the slide ring portions 212 at the both ends. In this case, the laying widths of the intermediate transfer belt 101 on the right and left slide ring portions 212 are different. When the friction force of the left side with the larger laying width (one axial side) is greater than the friction force of the right side (the other axial side), the steering roller 112 is tilted and lowered on the left side. As a result, the driving roller 110 and the steering roller 112 go out of alignment, and the intermediate transfer belt 101 leans to the right side in the winding portion of the steering roller 112 to correct the leaning of the belt position. Meanwhile, when the intermediate transfer belt 101 leans to the right side (the other axial side) as illustrated in FIG. 4C, the friction force between the intermediate transfer belt 101 and the slide ring portion 212 on the right side (the other axial side) increases to tilt the steering roller 112 to be lowered on the right side. As a result, the intermediate transfer belt 101 leans to the left side (the one axial side) in the winding portion of the steering roller 112 to correct the leaning of the belt position.

In the intermediate transfer unit 200, generally, when the intermediate transfer belt 101 is rotationally driven, the intermediate transfer belt 101 leans to one side under the influence of the misalignment of the tension rollers and the slight longitudinal distribution of the roller diameters. In response to this, the balance of friction force between the intermediate transfer belt 101 and the slide ring portions 212 at the both ends gradually changes to tilt the steering roller 112. This gradually slows down the leaning speed of the intermediate transfer belt 101, and then the intermediate transfer belt 101 converges on the steering tilt posture in which the belt leaning is balanced out.

(Intermediate Transfer Belt Cleaner)

Figure 5:
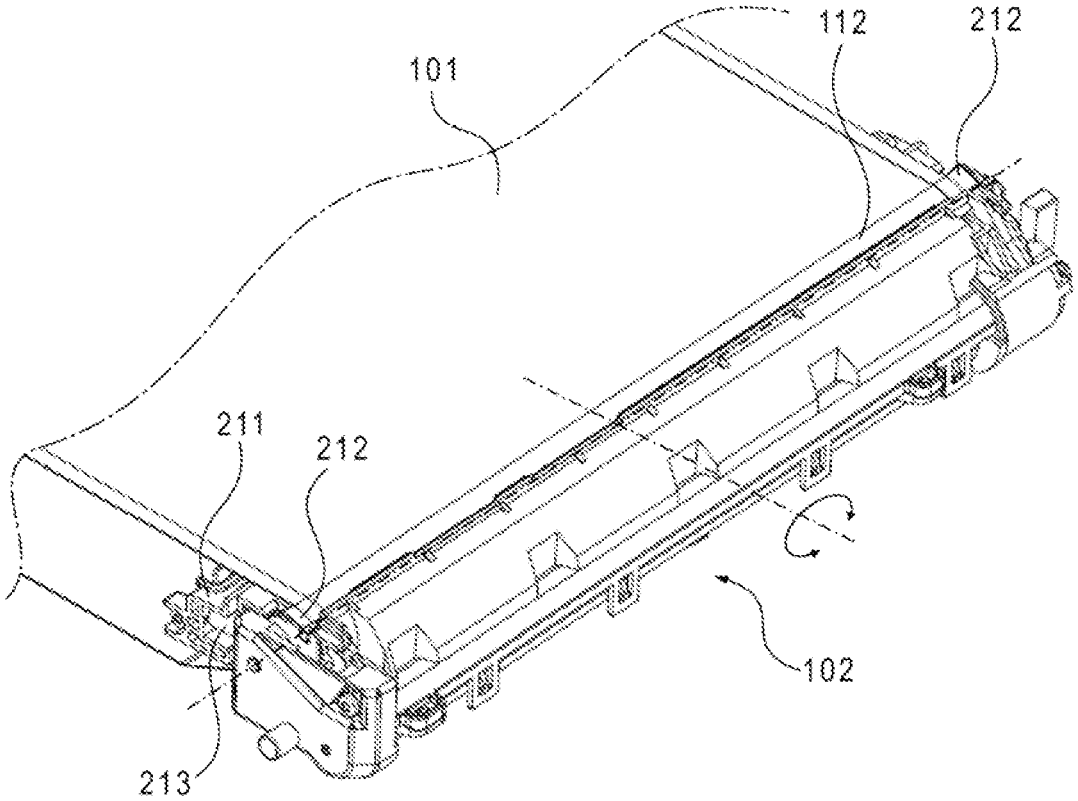
FIG. 5 is a perspective view of an intermediate transfer belt cleaner in an attached state.
Figure 6:
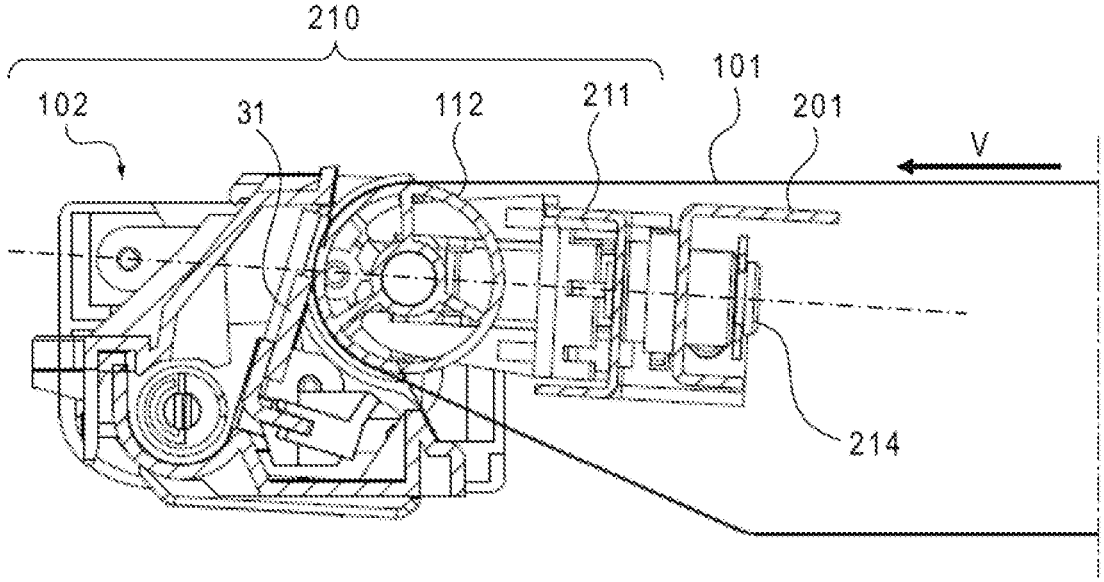
FIG. 6 is a cross-sectional view of the intermediate transfer belt cleaner in the attached state.

FIG. 5 is an illustrative diagram of the intermediate transfer belt cleaner 102 in the attached state, and FIG. 6 is a cross-sectional view of the same. The steering unit tiltably supported by the frame 201 includes the intermediate transfer belt cleaner 102 as a cleaning unit that abuts with the intermediate transfer belt 101 at a position opposed to the steering roller 112 to clean up the intermediate transfer belt 101.

The intermediate transfer belt cleaner 102 brings the leading end of a cleaning blade 31 into abutment with the position opposed to the steering roller 112 via the intermediate transfer belt 101 to collect the transfer residual toner on the intermediate transfer belt 101. As described above, the steering roller 112 has the both ends rotationally supported by the slide ring portions (bearing members) 212. The steering roller 112 is supported via the compression spring 213 to be slidable on the steering roller support member 211. The intermediate transfer belt cleaner 102 has the both ends fixed to the slide ring portions 212 to integrate with the steering roller 112 and tilt together with the steering roller support member 211. That is, even when the intermediate transfer belt 101 leans to one side to tilt the steering roller 112, the cleaning blade 31 can press the intermediate transfer belt 101 at a constant position in parallel to the intermediate transfer belt 101 to keep the state of friction with the intermediate transfer belt 101 in a stable manner.

Hereinafter, the steering roller 112 and the intermediate transfer belt cleaner 102 tilted together with the steering roller support member 211 by the rotation shaft 214 with respect to the frame 201 of the intermediate transfer unit 200 will be collectively called steering portion (steering unit) 210. In the intermediate transfer unit 200, the steering portion 210 is provided downstream of the frame 201 as seen from the attachment direction.

(Attachment and Detachment Configuration of the Intermediate Transfer Unit)

Figure 7:
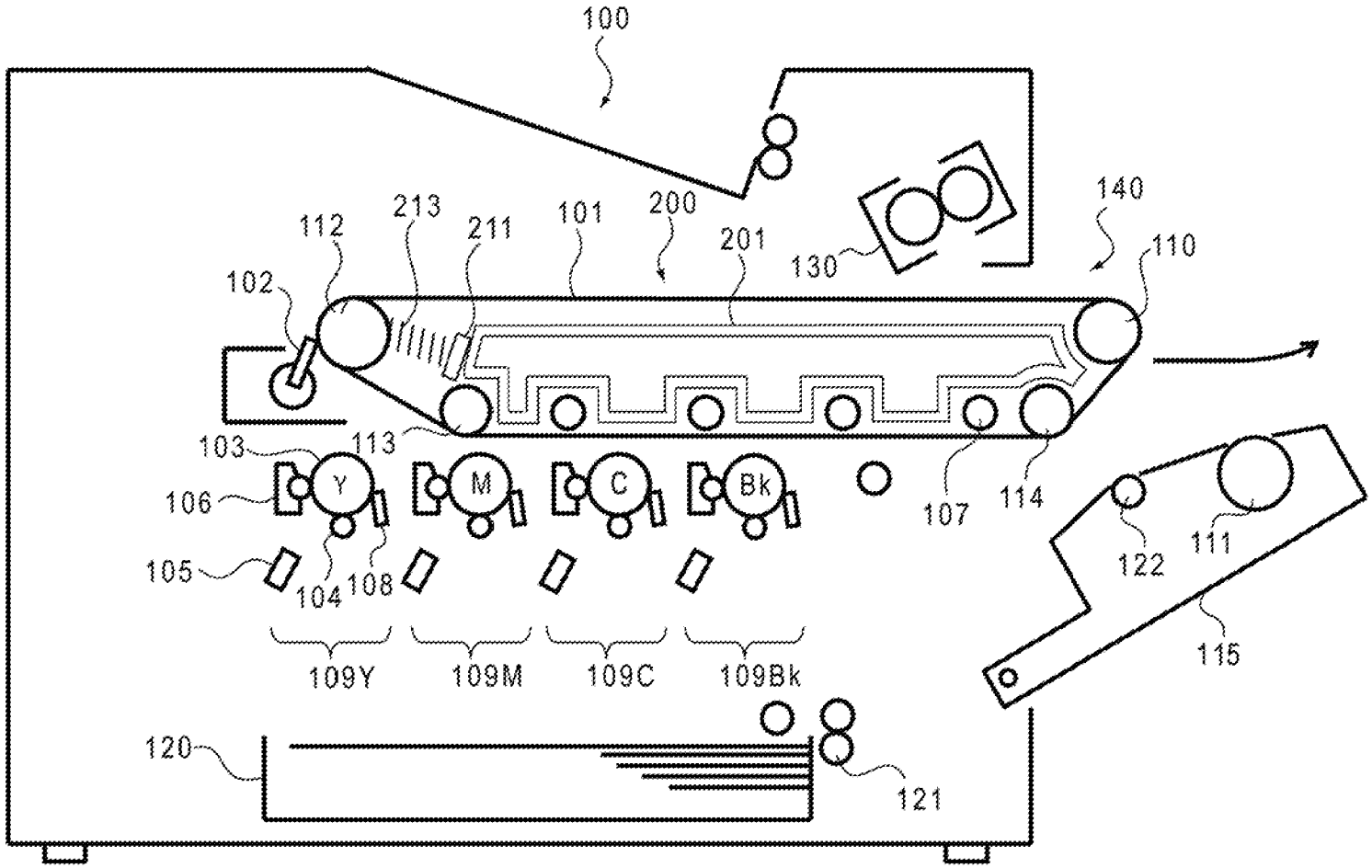
FIG. 7 is an illustrative diagram of the image forming apparatus from which an intermediate transfer unit is pulled out through an opening portion.

As illustrated in FIG. 7, the image forming apparatus 100 has an opening portion 140 on one side surface where the four image forming portions 109 are aligned. The intermediate transfer unit 200 can be attached to and detached from the interior of the housing of the image forming apparatus 100 through the opening portion 140. The image forming apparatus 100 has the one side surface with an opening and closing member 115 that can be opened and closed with respect to the image forming apparatus 100. The opening portion 140 can be opened by opening the opening and closing member 115 as illustrated in FIG. 7. In this case, attached to the opening and closing member 115 are the secondary transfer outer roller 111 opposed to the driving roller (the secondary transfer inner roller) 110 of the intermediate transfer unit 200 and one of the registration rollers 122. Therefore, the conveyance path of the transfer material can also be opened by opening the opening and closing member 115.

Figure 8:
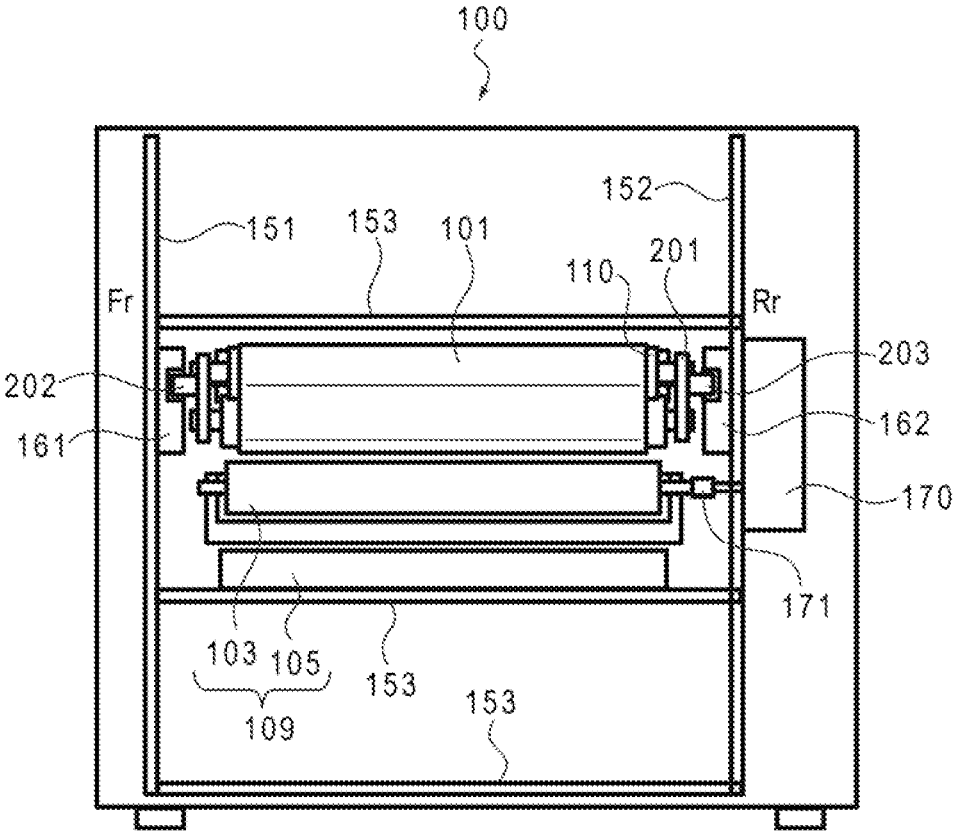
FIG. 8 is an illustrative diagram of a side plate configuration of the image forming apparatus.

FIG. 8 is an illustrative diagram of the image forming apparatus 100 as seen from the opening portion 140 side. As illustrated in FIG. 8, the housing (apparatus body) of the image forming apparatus 100 has opposed side plates 151 and 152 coupled to each other by a plurality of stays 153. The intermediate transfer unit 200 installed in the image forming apparatus 100 includes guide ribs (first guided portions) 202 and 203 on both side surfaces of the frame 201 as seen from the axial direction of the tension rollers. On the inner wall surfaces of the side plates 151 and 152 of the image forming apparatus 100, guide rails (first guiding portions) 161 and 162 are opposed to the guide ribs 202 and 203 to hold the guide ribs 202 and 203. In the image forming apparatus of the embodiment illustrated in FIG. 7, the four image forming portions 109 including the photosensitive drums 103 are arranged under the intermediate transfer unit 200, and are rotationally driven via a cup ring 171 by a drive unit 170 provided on the one sideplate 152 as illustrated in FIG. 8. Therefore, the intermediate transfer unit 200 is inserted or removed while passing over the image forming portions 109 in the alignment direction as illustrated in FIG. 7.

Figure 9:
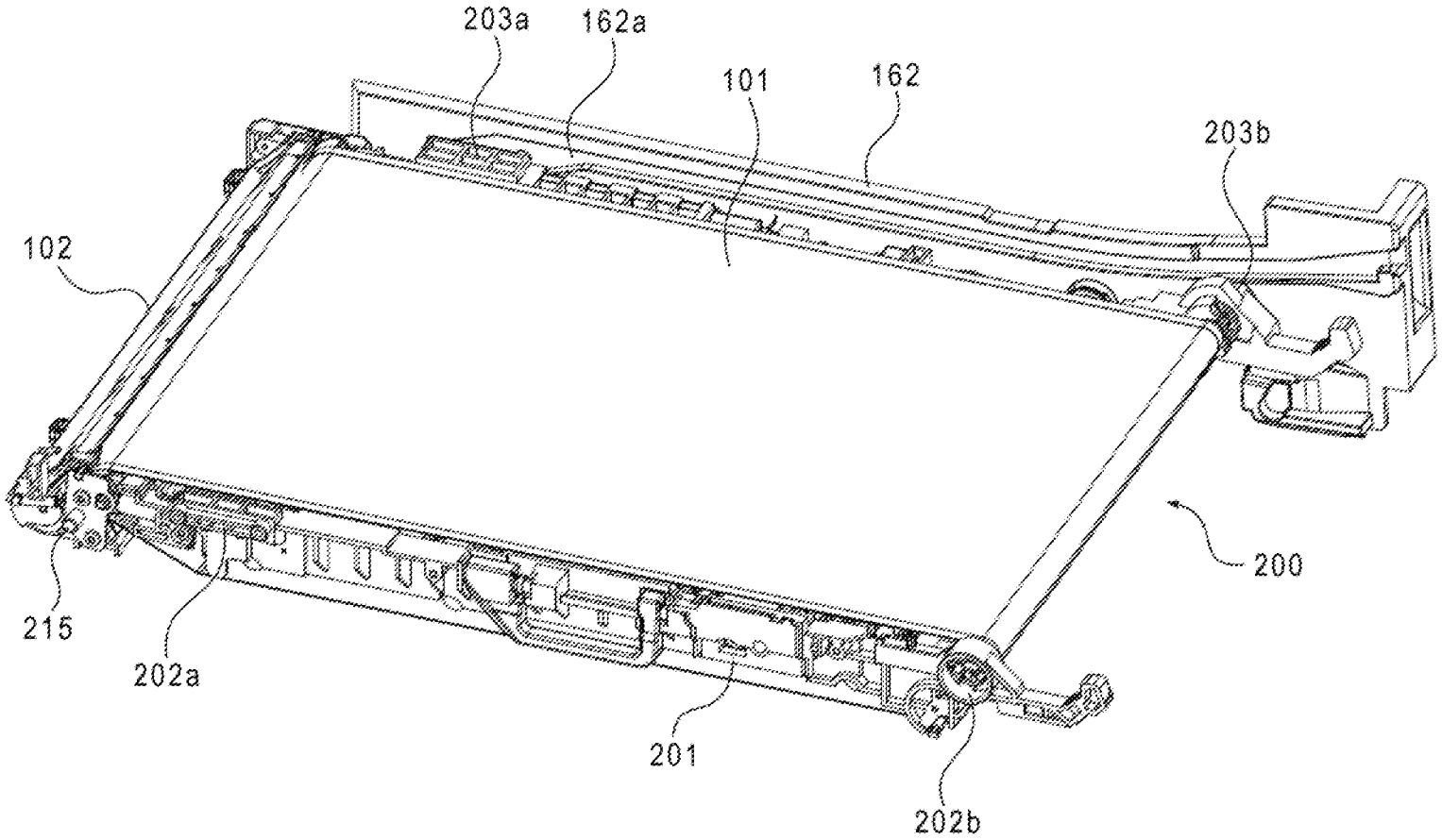
FIG. 9 is a perspective view of the intermediate transfer unit attached to guide rails.
Figure 10:
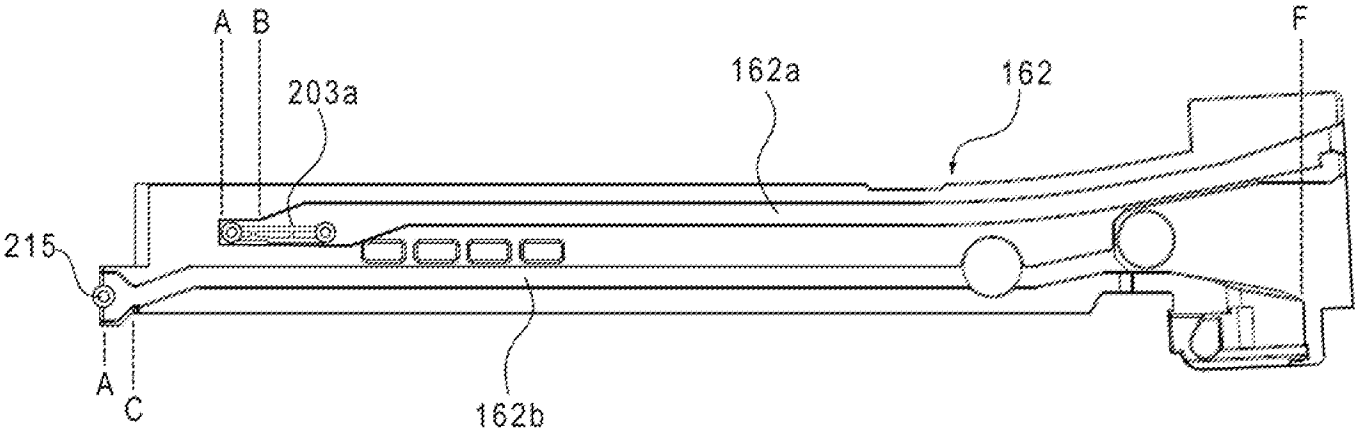
FIG. 10 is an illustrative diagram of the guide rail.
Figure 11:
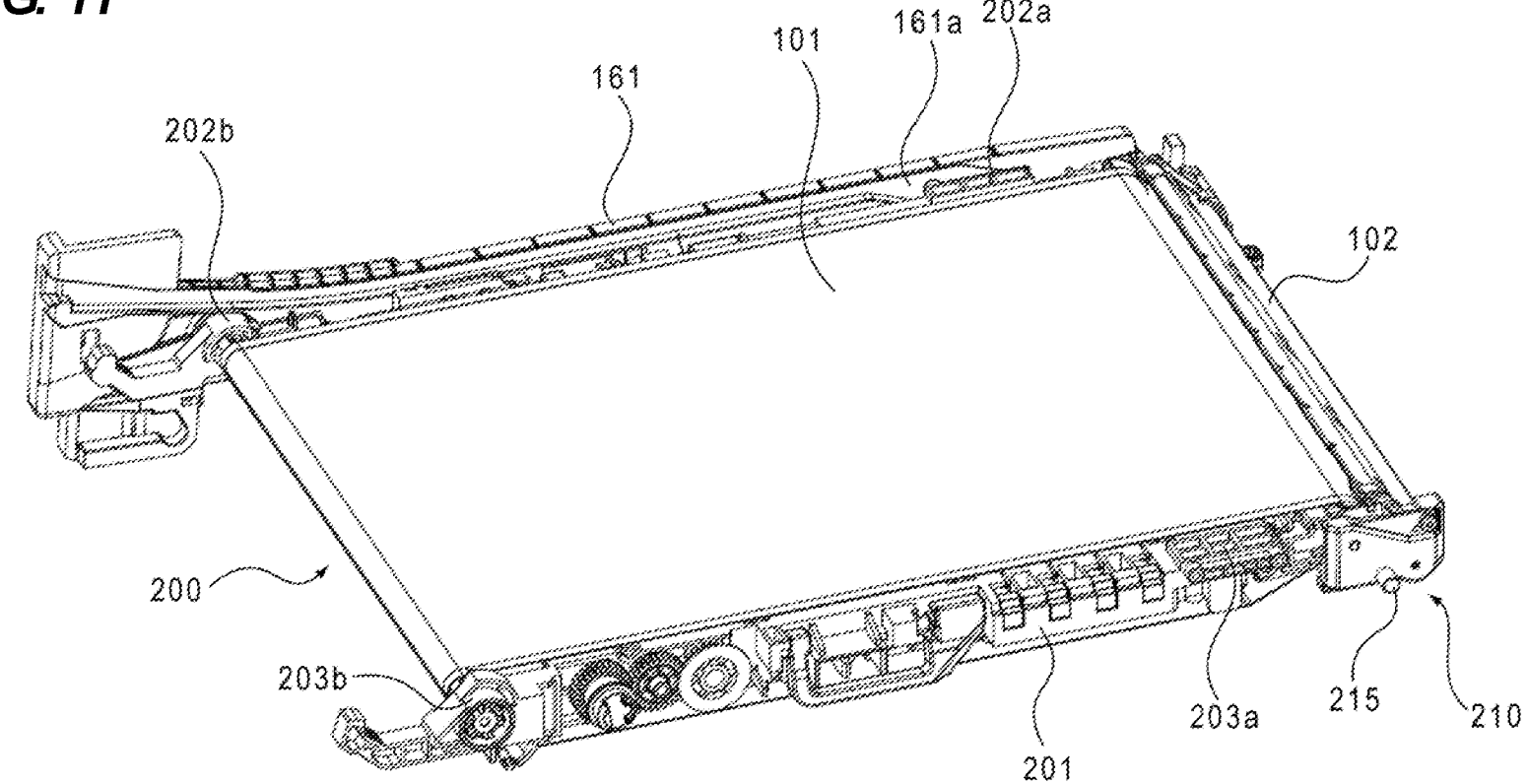
FIG. 11 is a perspective side view of the intermediate transfer unit.

FIG. 9 is a perspective view of the intermediate transfer unit 200 attached to the guide rail 162. In fact, the guide rail 161 is also arranged at a position opposed to the guide rail 162, but FIG. 9 does not illustrate the guide rail 161 for the purpose of showing the side surface of the intermediate transfer unit 200. FIG. 10 is an illustrative diagram of the guide rail 162, and FIG. 11 is a perspective view of the side surface of the intermediate transfer unit opposed to the guide rail 162. In the example of FIG. 11, the guide rail 162 is also arranged at a position opposed to the guide rail 161, but FIG. 11 does not illustrate the guide rail 162 for the purpose of showing the side surface of the intermediate transfer unit 200.

As described above, when the image forming apparatus is in the standby state, the intermediate transfer belt 101 is separated from the four photosensitive drums 103 (see FIG. 2C). However, when the intermediate transfer unit 200 is inserted or removed, the posture of the intermediate transfer unit becomes unstable due to play between the guide ribs 202 and 203 of the intermediate transfer unit 200 and the guide rails 161 and 162 of the apparatus housing. To avoid a contact between the intermediate transfer unit 200 and the image forming portions 109 including the photosensitive drums 103, it is desirable to leave a larger clearance between them than that in the standby state of the apparatus.

Accordingly, the guide rails 161 and 162 are provided with guide grooves (first guiding portions) 161*a* and 162*a* to support the guide ribs (first guided portions) 202 and 203 of the frame 201. The guide grooves 161*a* and 162*a* in the guide rails 161 and 162 are not linear but are bent to lift the intermediate transfer unit 200 at a position B shifted by a predetermined amount from an attachment position A as illustrated in FIG. 10. However, this increases upwardly the space necessary for insertion and removal of the intermediate transfer unit for the height at which the intermediate transfer unit 200 is to be lifted. In the intermediate transfer unit made longer in the insertion and removal direction as in Example 1, the frame 201 is provided with the plurality of guide ribs 202 and 203 supported by the guide rails 161 and 162 in the insertion and removal direction. In this case, as illustrated in FIGS. 9 and 11, guide ribs 202*a* and 202*b* and guide ribs 203*a* and 203*b* as first guided portions are respectively arranged on upstream and downstream sides of the frame 201 in the insertion and removal direction. In the guide grooves 161*a* and 162*a* constituting the first guiding portions, the positions A and B refer to a first position including an attachment position where the intermediate transfer unit 200 as the belt conveyance device is located and attached to the apparatus body, and a second position higher than the first position by the height at which the intermediate transfer unit 200 is to be lifted. The attachment position here refers to the position where the intermediate transfer unit 200 is located and attached to the apparatus body (housing) of the image forming apparatus.

In this manner, the intermediate transfer unit 200 is regulated in posture during insertion or removal by supporting and guiding the guide ribs 202 and 203 on the both side surfaces of the frame 201 along the guide grooves 161*a* and 162*a* in the guide rails 161 and 162 of the image forming apparatus 100. This makes it possible to avoid the intermediate transfer unit 200 from contacting surrounding components such as the image forming portions 109 under the intermediate transfer unit 200 and the stays 153 above the intermediate transfer unit 200, thereby preventing scratches on the intermediate transfer belt 101.

Meanwhile, in the intermediate transfer unit 200, the posture of the steering portion 210 tiltable with respect to the frame 201 is not sufficiently regulated only by the guide ribs 202 and 203. That is, when the steering roller 112 tilts depending on the leaning position of the intermediate transfer belt 101, the steering portion 210 has the end lowered on the leaning side of the intermediate transfer belt 101 and may contact the image forming portions 109 under the intermediate transfer unit during insertion or removal.

Accordingly, in Example 1, the end of the steering portion 210 has a guide projection (second guided portion) 215 as illustrated in FIG. 11. Further, the opposed guide rail 162 of the image forming apparatus 100 has a second guide groove (second guiding portion) 162*b* to support the guide projection 215 as illustrated in FIG. 10. The second guide groove 162*b* supports the guide projection 215 to regulate the posture of the steering portion 210 while the steering portion 210 passes from an attachment start position F in the opening portion 140 of the image forming apparatus 100 over the image forming portions 109. However, after the steering portion 210 passes over the image forming portions 109, the second guide groove 162*b* releases the guide projection 215 at a position C in front of the attachment position (attachment completion position) A. In the process of attaching the intermediate transfer unit 200 to the apparatus body, the second guide groove 162*b* guides the intermediate transfer unit 200 from the second position to the first position, and then releases the guide projection 215. Accordingly, the posture of the steering portion 210 becomes tiltable with respect to the frame 201 positioned by the first guide grooves 161*a* and 162*a* at the attachment position of the intermediate transfer unit 200, which allows autonomous steering against the leaning of the intermediate transfer belt 101.

FIG. 10 illustrates the second guide groove (second guiding portion) 162*b* in the guide rail 162. In addition to this, a second guide groove (second guiding portion) 161*b* may be provided in the opposed guide rail 161 and the guide projection (second guided portion) 215 illustrated in FIG. 9 may be provided at the end of the steering portion 210 opposed to the guide rail 161 to regulate the posture of the steering portion 210 on the both axial sides. FIG. 11 illustrates the guide projection 215 arranged on the side surface of the intermediate transfer belt cleaner 102. However, the guide projection 215 maybe provided at the end of the steering roller support member 211, for example, as far as it can be tilted with respect to the frame 201. In the guide grooves 161*b* and 162*b* constituting the second guiding portions, the positions A and C refer to a first position including the attachment position where the intermediate transfer unit 200 as the belt conveyance device is located and attached to the apparatus body, and a second position higher than the first position by the height at which the intermediate transfer unit 200 is to be lifted.

Figure 12A:
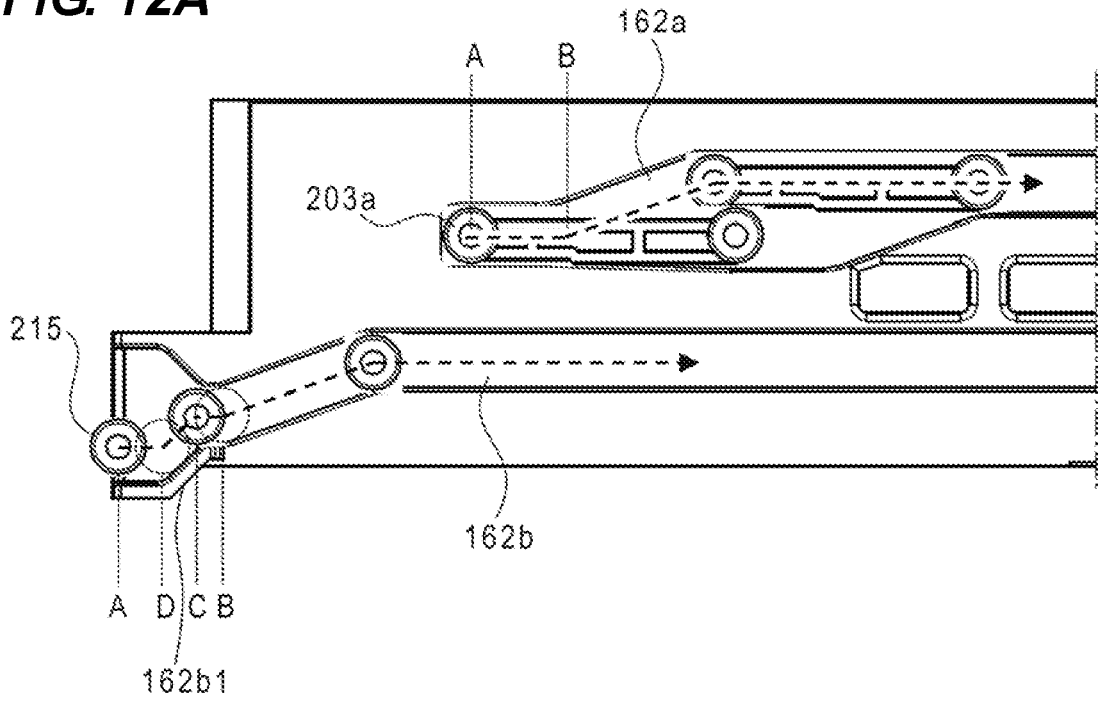
FIGS. 12A and 12B are illustrative diagrams of posture correction of a tilted steering portion.
Figure 12B:
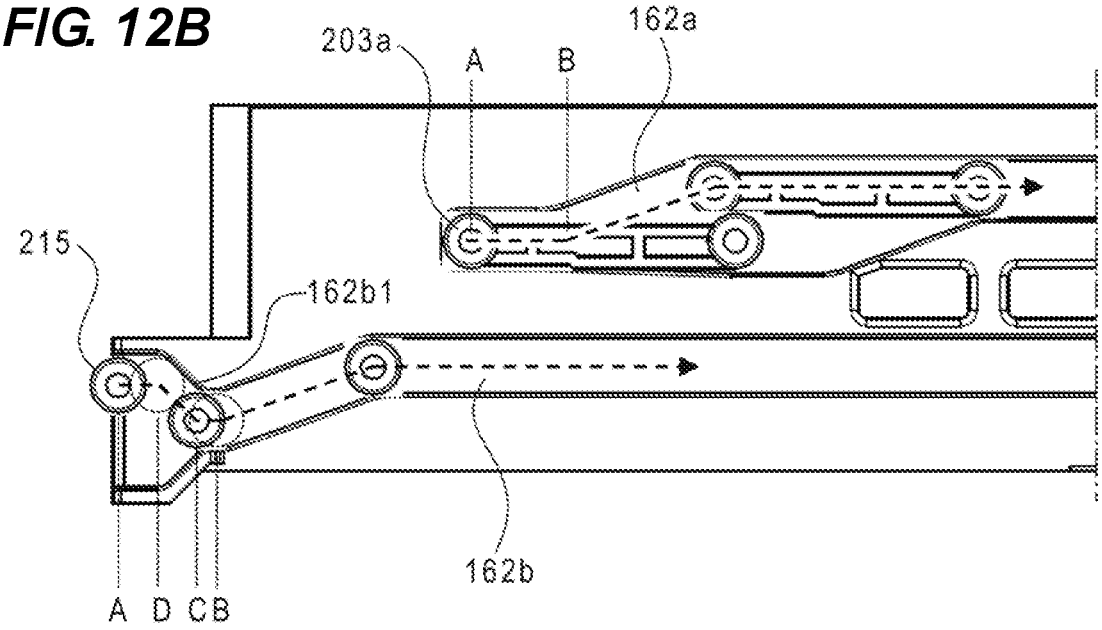

When the intermediate transfer unit 200 is detached, the steering portion 210 is tilted at the attachment position A depending on the leaning position of the intermediate transfer belt 101, and the end of the steering portion 210 on the lean side of the intermediate transfer belt 101 is lowered as compared to the portion in vicinity of the rotation shaft 214. Accordingly, as illustrated in FIGS. 12A and 12B, the intermediate transfer unit 200 starts to be moved from the attachment position A to the opening portion 140 of the image forming apparatus 100, and then the guide projection 215 at the end of the steering portion 210 is guided from a position D by the second guide groove 162*b*. That is, the second guide groove 162*b* has a regulation portion 162*b*1 that, in the process of detaching the intermediate transfer unit 200 from the apparatus body, supports the released guide projection 215 to regulate the position of the steering portion 210. After supporting the guide projection 215 by the regulation portion 162*b*1 to regulate the position of the steering portion 210, the second guide groove 162*b* guides the intermediate transfer unit 200 to the second position higher than the first position. This makes it possible to correct the tilted posture of the steering portion 210 such that the steering roller 112 becomes approximately parallel to the other tension rollers supported by the frame 201.

The second guide groove 162*b* is arranged to press the guide projection 215 from above and under the guide projection 215 even when the steering portion 210 is tilted at the maximum. FIG. 12A illustrates a path on which the guide projection 215 displaced (moved) downward due to the tilt of the steering portion 210 is pressed upward by the regulation portion 162*b*1 of the guide groove 162*b* from the position D to the position C to correct the tilted posture of the steering portion 210, and then the guide projection 215 is moved along the guide groove 162*b*. FIG. 12B illustrates a path on which the guide projection 215 displaced (moved) upward due to the tilt of the steering portion 210 is pressed downward by the regulation portion 162*b*1 of the guide groove 162*b* from the position D to the position C to correct the tilted posture of the steering portion 210, and then the guide projection 215 is moved along the guide groove 162*b*. In this manner, the regulation portion 162*b*1 of the guide groove 162*b* is formed to press the displaced guide projection 215 in both the upward and downward directions as illustrated in FIGS. 12A and 12B.

When the second guide grooves 161*b* and 162*b* are provided in the opposed guide rails 161 and 162 on the both sides of the intermediate transfer unit 200 to correct the tilted posture of the steering portion 210 by the guide projections 215 at the both ends of the steering portion 210, the second guide grooves 161*b* and 162*b* may press the guide projection 215 either upward or downward. In Example 1, the guide projection 215 is projected laterally from the steering portion 210, and the second guide grooves 161*b* and 162*b* are made to be concave. However, these components are not limited to the foregoing shapes as long as they can support and regulate the ends of the steering portion 210.

As described above, according to Example 1, the steering portion 210 can be freely tilted at the attachment position, and is guided together with the frame 201 by the guide rails 161 and 162 in the process of attachment and detachment. This makes it possible to achieve the tilt of the steering portion 210, regulate the sagging of the steering portion 210, and suppress increase in the space necessary for insertion and removal without interference with structures such as the image forming portions under the path of insertion and removal.

EXAMPLE 2

Figure 13:
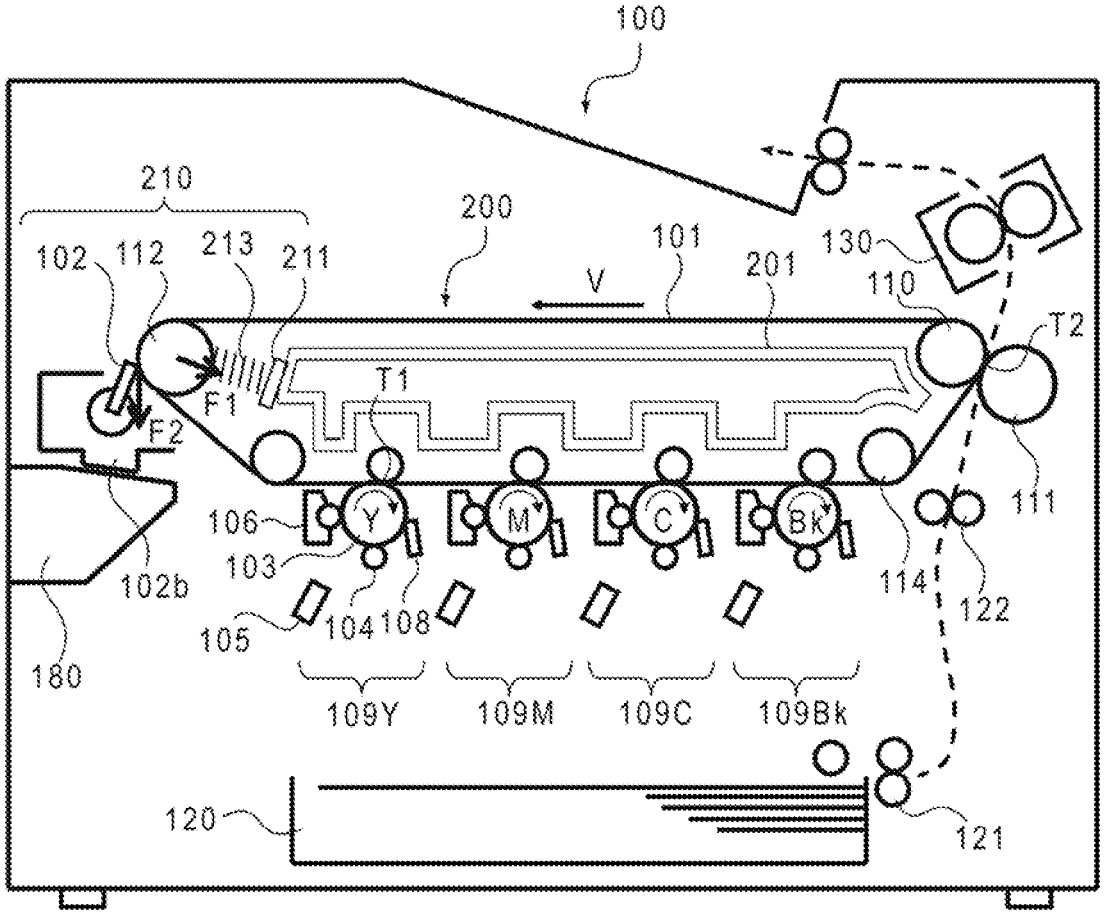
FIG. 13 is an illustrative diagram of a configuration of an image forming apparatus in Example 2.
Figure 14:
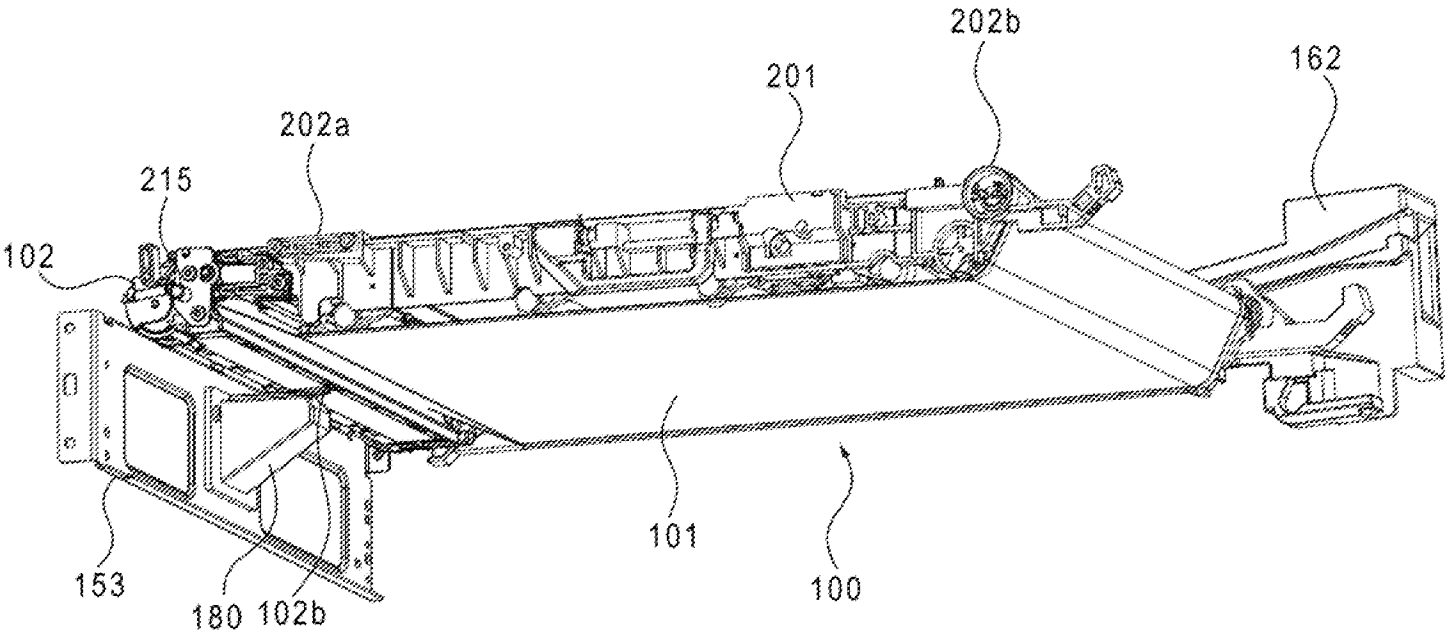
FIG. 14 is a perspective view of an intermediate transfer unit in an attached state in Example 2.
Figure 15:
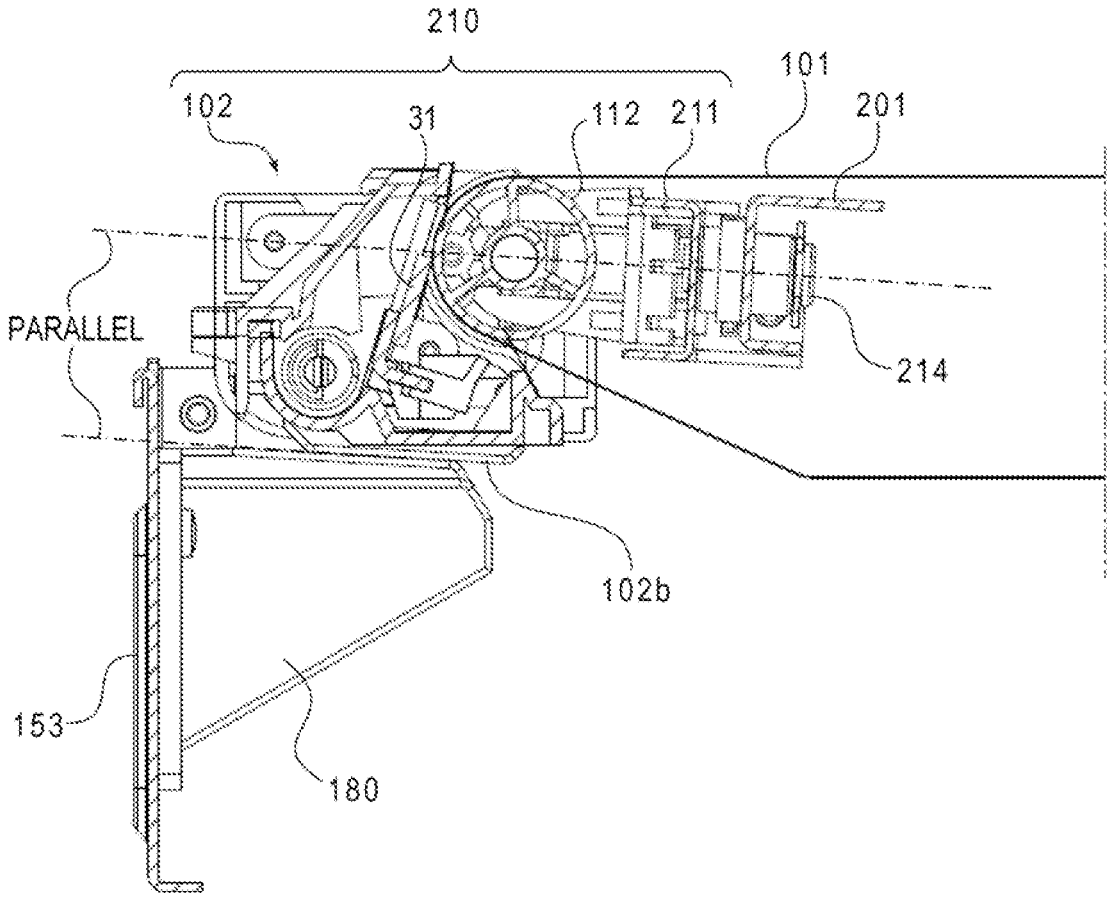
FIG. 15 is a cross-sectional view of a steering portion and its vicinity in Example 2.

FIG. 13 is an illustrative diagram of an image forming apparatus in Example 2. FIG. 14 is a perspective view of the intermediate transfer unit 200 in the attached state according to Example 2, and FIG. 15 is a cross-sectional view of the steering portion 210 and its vicinity. The schematic configuration of the image forming apparatus in Example 2 is almost identical to that of Example 1 described above, and the members with identical functions will be given the identical reference signs, and descriptions of them will be omitted.

As described above, the steering portion 210 is supported via the rotation shaft 214 in such a manner as to be tiltable with respect to the frame 201 of the intermediate transfer unit 200. The rotation shaft 214 bears the weight of the steering portion 210. As illustrated in FIG. 13, a diagonally downward resultant force F1 acts on the steering roller 112 due to a belt tension applied to the intermediate transfer belt 101. At the time of rotation of the intermediate transfer belt, a downward force F2 acts on the steering portion 210 due to friction force of the cleaning blade 31 in abutment with the outer peripheral surface of the belt. In this manner, when the downward force acts on the steering portion 210 to generate an excessive bending force on the frame 201 supporting the rotation shaft 214, the frame 201 gets deformed to displace downward and sag the steering portion 210. As a result, there occurs problems such as reduction in the ability of returning the leaning belt due to inhibition of the autonomous steering operation and image failure without application of desired belt tension.

Accordingly, as illustrated in FIGS. 14 and 15, the stay 153 constituting the housing of the image forming apparatus 100 includes a second support portion 180 supporting the steering portion 210 at a position approximately identical to the position of the rotation shaft 214 as seen from the axial direction of the steering roller. The second support portion 180 is a support portion that is provided in the apparatus body to support the steering portion 210 to be tiltable with respect to the frame 201 around the axial line vertical to the axial line of the steering roller. Accordingly, the second support portion 180 bears the downward force applied to the steering portion 210 to prevent the sagging of the steering portion 210. In Example 2, the bottom of the housing of the intermediate transfer belt cleaner 102 has an abutment portion 102*b* to the second support portion 180.

Figure 16:
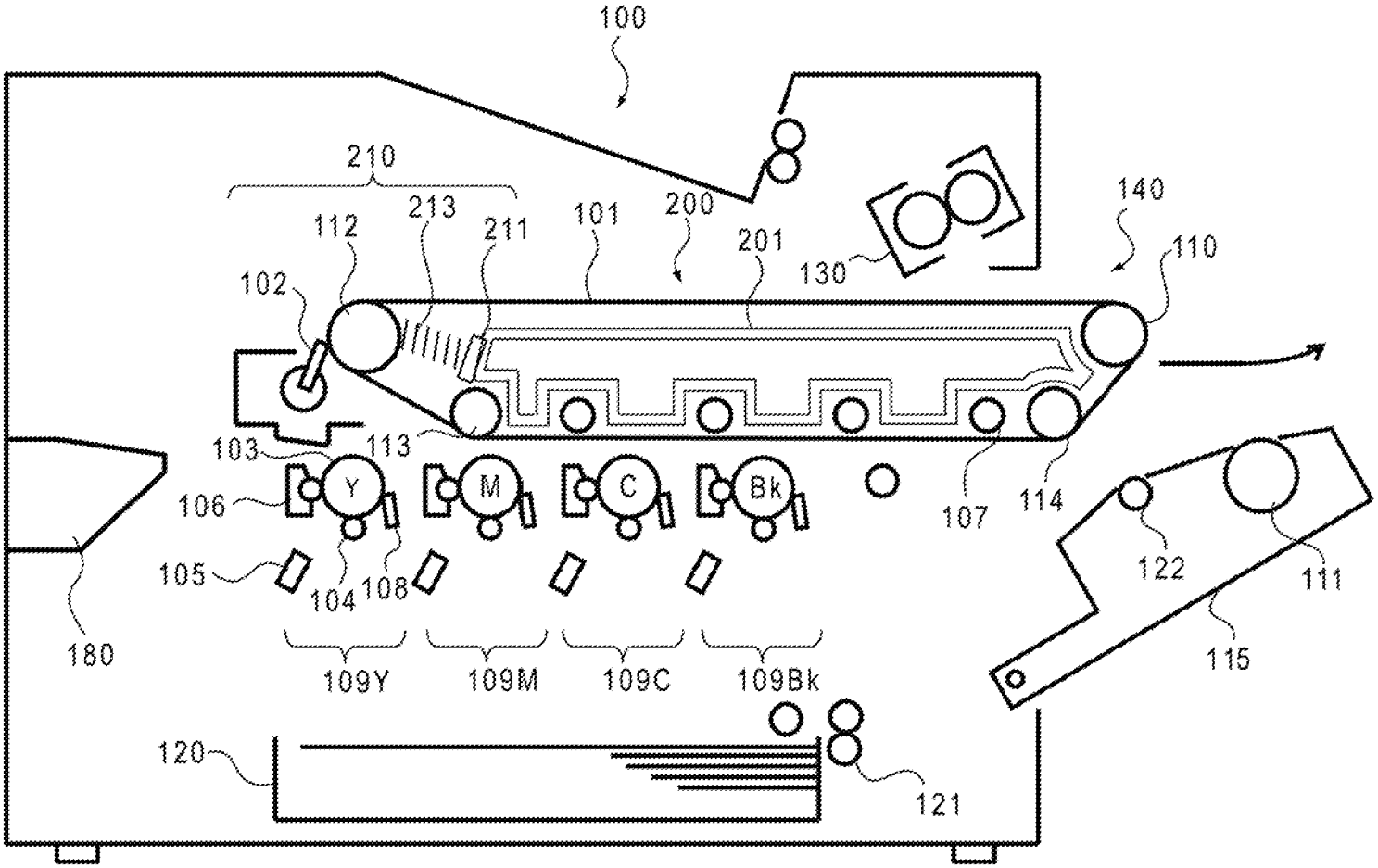
FIG. 16 is an illustrative diagram of the image forming apparatus from which the intermediate transfer unit is pulled out through an opening portion in Example 2.

According to this configuration, as illustrated in FIG. 15, the steering portion 210 can be supported by the second support portion 180 at the attachment position of the intermediate transfer unit 200. However, when the intermediate transfer unit 200 is inserted into or removed from the image forming apparatus 100, the abutment portion 102*b* of the steering portion 210 separates from the second support portion 180 as illustrated in FIG. 16. Thus, the steering portion 210 is not supported by the second support portion 180 but sags under its own weight and by the action of the belt tension.

Accordingly, at the insertion or removal of the intermediate transfer unit 200, the guide projection 215 at least at one end of the steering portion 210 is supported by the second guide groove 161*b* (or 162*b*) in the guide rail 161 (or 162) of the image forming apparatus 100. This suppresses the sagging of the steering portion 210 at the insertion or removal of the intermediate transfer unit 200. When the steering portion 210 sags significantly without being supported by the second support portion 180, it is desirable to provide the guide projection 215 at the both ends of the steering portion 210 so that the posture of the steering portion 210 can be regulated by the second guide grooves 161*b* and 162*b* in the guide rails 161 and 162 on the both sides.

Figure 17:
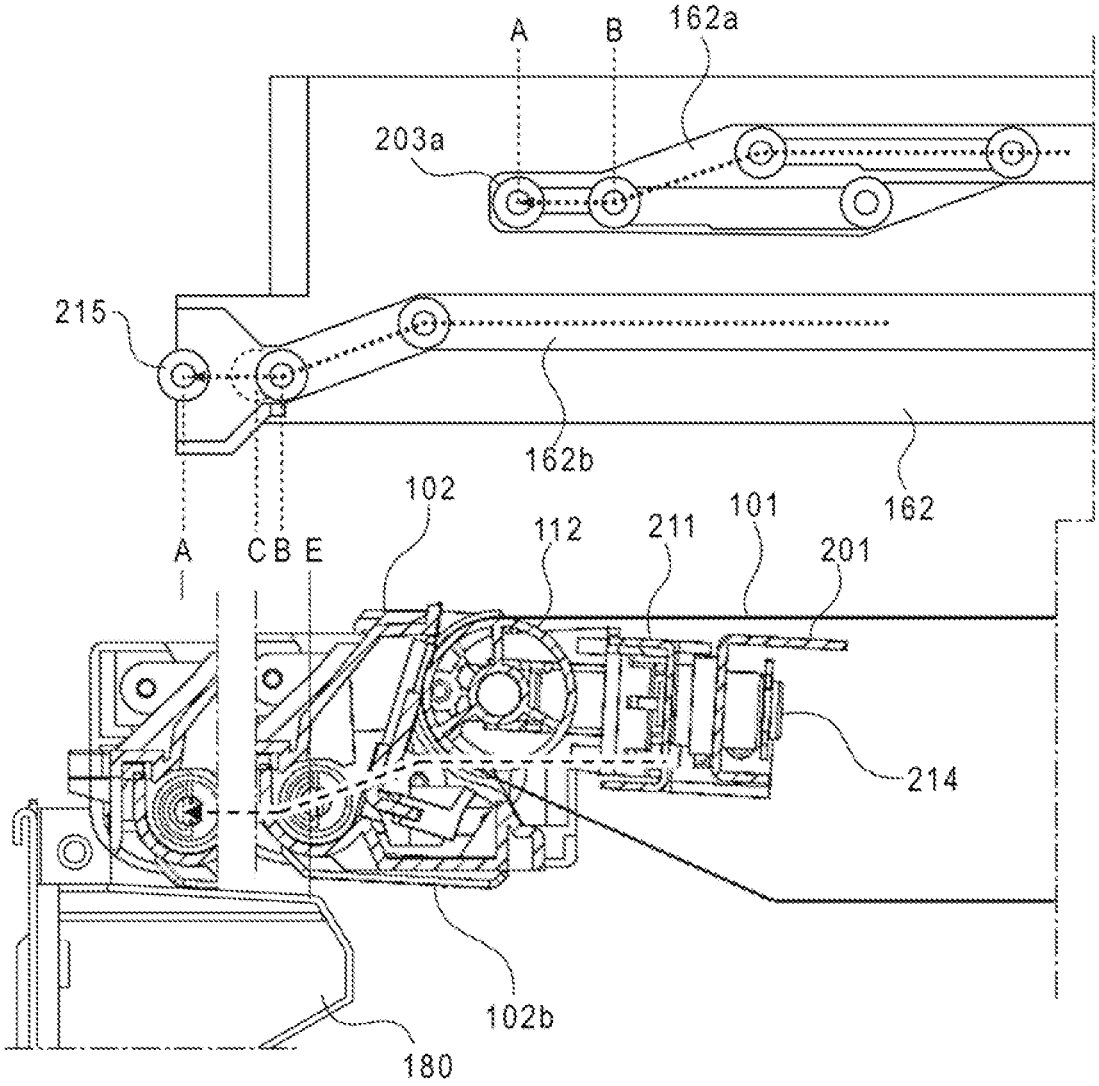
FIG. 17 is an illustrative diagram of guide positions in the process of attachment of the intermediate transfer unit in Example 2.

As described above, to achieve autonomous steering against the leaning of the intermediate transfer belt 101, the second guide groove 161*b* (or 162*b*) releases the guide projection 215 at the position C in front of the attachment position (attachment completion position) A in the process of attaching the intermediate transfer unit 200 to the apparatus body. Meanwhile, the abutment portion 102*b* in proximity to the rotation shaft 214 of the steering portion 210 reaches the second support portion 180 of the image forming apparatus 100 from a position E in front of the attachment position (attachment completion position) A. In this case, the steering portion 210 is supported by not only the rotation shaft 214 but also the guide projection 215 at the axial end or the abutment portion 102*b* in the axial center to prevent the sagging of the steering portion 210. From that viewpoint, as illustrated in FIG. 17, the release position C of the guide projection 215 from the second guide groove 162*b* is located on the downstream side of the supportable position E of the abutment portion 102*b* by the second support portion 180 as seen from the attachment direction (reaching the position C after the position E). The steering portion 210 supported by the guide projection 215 is lowered together with the frame 201 guided by the guide ribs 202 and 203 to the positioning height at the position B (first position). However, in the process of attaching the intermediate transfer unit 200 to the apparatus body, it is desirable to set the position B on the downstream side of the supportable position E of the abutment portion 102*b* by the second support portion 180 as seen from the attachment direction (reaching the position B after the position E) so that the abutment portion 102*b* of the steering portion 210 is lowered from above and placed on the second support portion 180.

Figure 18:
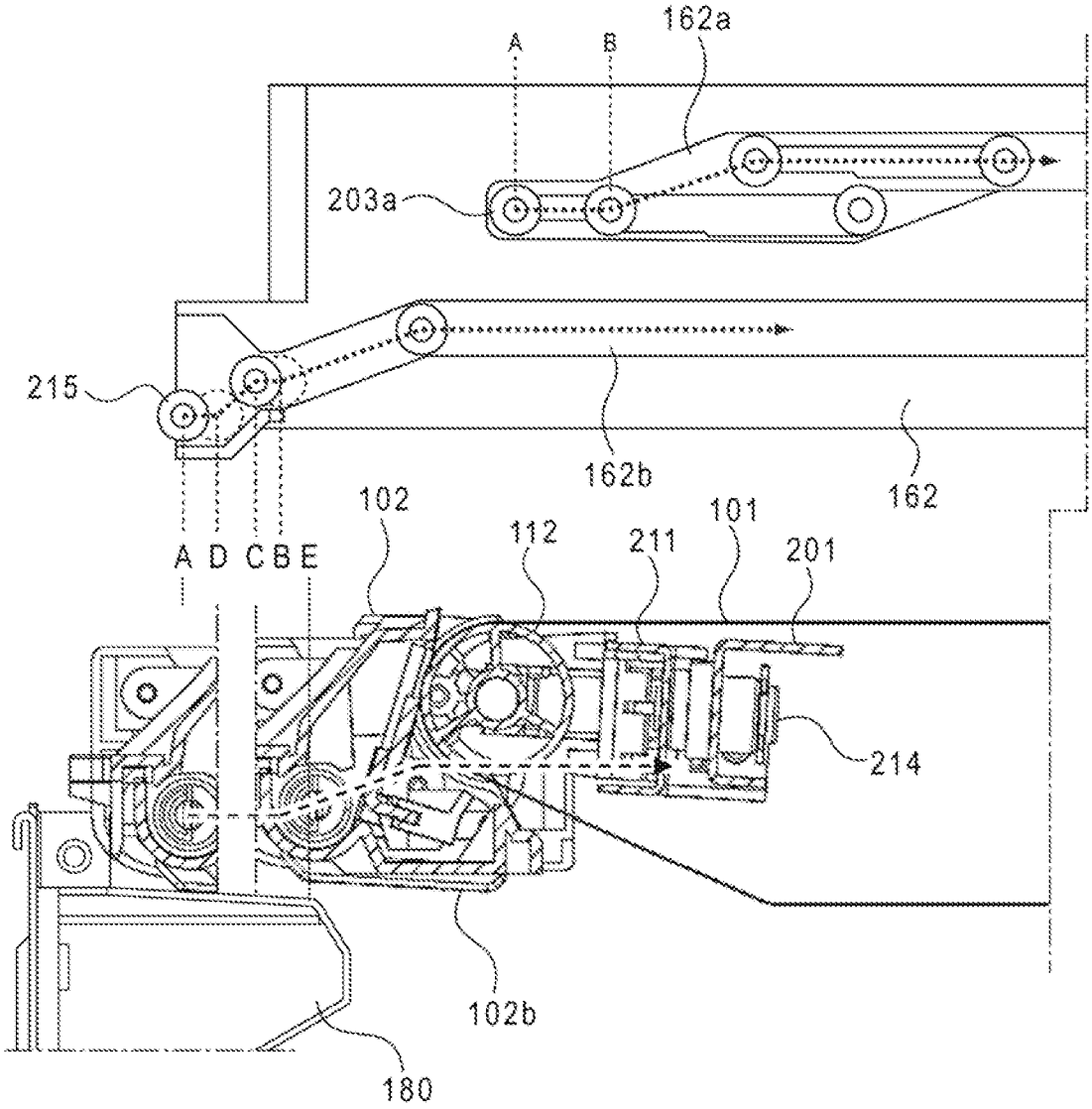
FIG. 18 is an illustrative diagram of guide positions in the process of detachment of the intermediate transfer unit in Example 2.

In the process of detaching the intermediate transfer unit 200 from the apparatus body, between the attachment position A and the position E where the second support portion 180 can support the abutment portion 102*b* of the steering portion 210 as illustrated in FIG. 18, the second guide grooves 161*b* and 162*b* guide the guide projections 215 from the position D to the position C to correct the tilted posture of the steering portion 210 and support the steering portion 210 to be approximately parallel to the frame 201. After that, the steering portion 210 is lifted together with the frame 201 from the positioning height (first position) to the insertion and removal height (second position) by the bending of the first guide grooves 161*a* and 162*a* and the second guide grooves 161*b* and 162*b* at the position B.

That is, in Example 2, in the process of attaching or detaching the intermediate transfer unit 200, there is an overlap between the section where the second support portion 180 supports tiltably the steering portion 210 and the section where the second guide grooves 161*b* and 162*b* support the guide projections 215. More specifically, in the process of attaching the intermediate transfer unit 200 to the apparatus body, the second support portion 180 supports the steering portion 210 before the second guide grooves 161*b* and 162*b* release the guide projections 215. In the process of detaching the intermediate transfer unit 200 from the apparatus body, the second support portion 180 supports the steering portion 210 until the second guide grooves 161*b* and 162*b* support the guide projections 215.

Accordingly, regulating the tilted posture and sagging of the steering portion 210 allows the intermediate transfer unit 200 to be inserted or removed without contact with the image forming portions 109 under the intermediate transfer unit 200. This eliminates the need to lift the intermediate transfer unit 200 excessively at the time of insertion or removal of the intermediate transfer unit 200, thereby suppressing increase in the space necessary for insertion and removal of the intermediate transfer unit 200.

EXAMPLE 3

Figure 19:
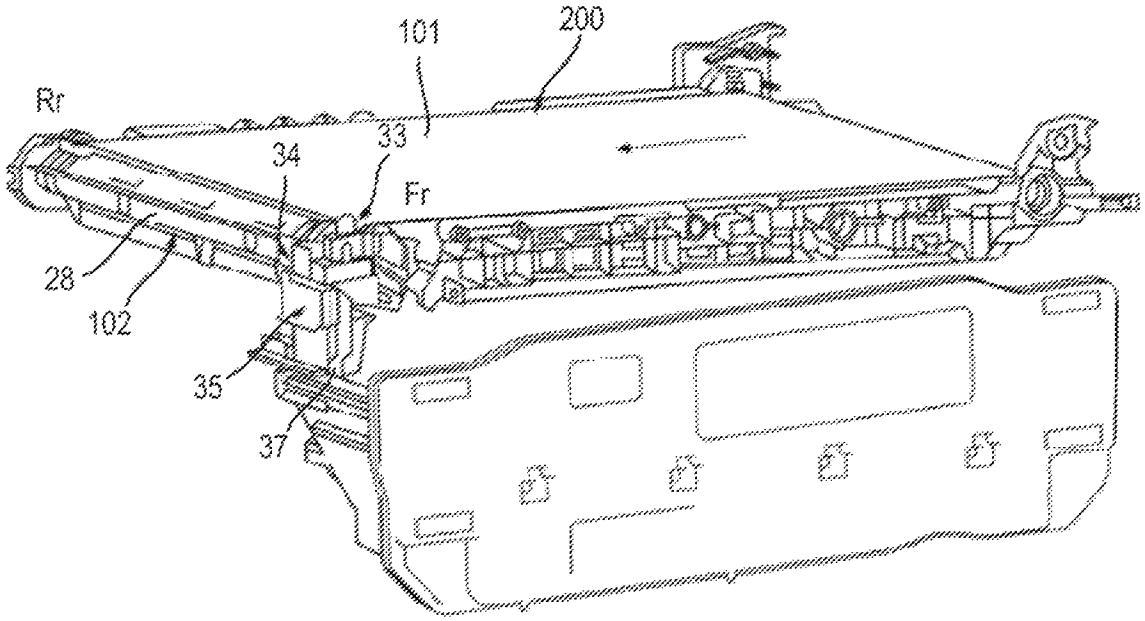
FIG. 19 is a perspective view of a collected toner conveyance portion in Example 3.
Figure 20:
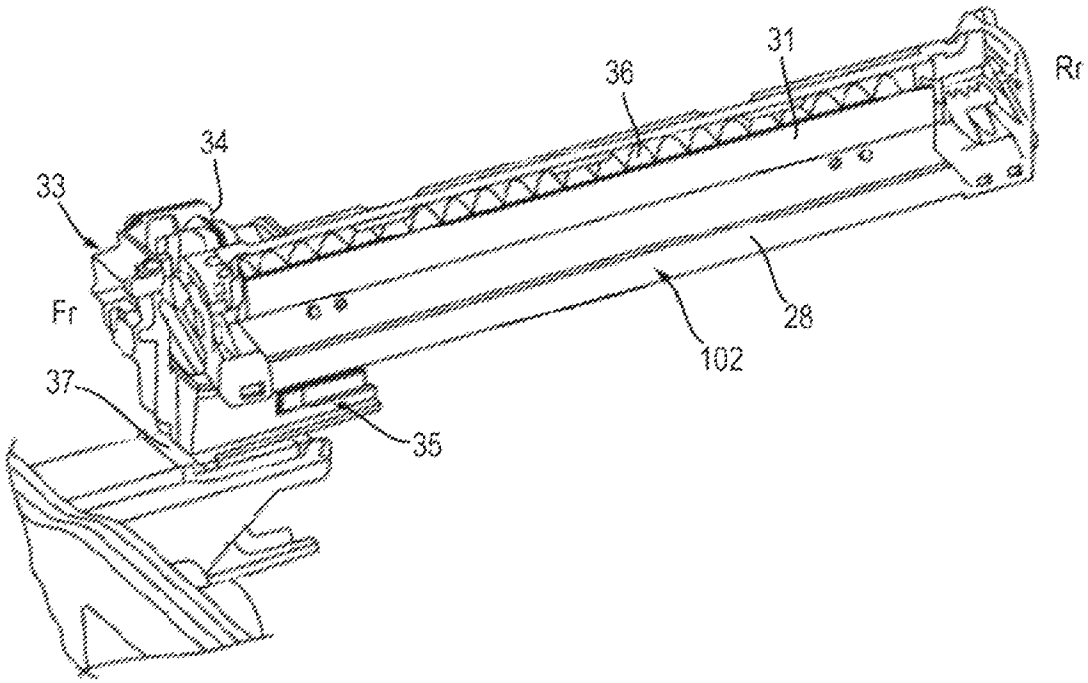
FIG. 20 is a perspective view of the collected toner conveyance portion without an intermediate transfer belt portion in Example 3.

FIGS. 19 to 26 are illustrative diagrams of an image forming apparatus in Example 3. FIG. 19 is a perspective view of an intermediate transfer unit and a collected toner conveyance portion in Example 3. FIG. 20 is a perspective view of the collected toner conveyance portion without the intermediate transfer belt portion in Example 3. The schematic configuration of the image forming apparatus in Example 3 is almost identical to those of Examples 1 and 2 described above, and the members with identical functions will be given the identical reference signs, and descriptions of them will be omitted.

As illustrated in FIG. 19, the transfer residual toner on the intermediate transfer belt 101 is scraped off by the cleaning blade 31 (see FIG. 20) in the cleaning container 28 of the intermediate transfer belt cleaner 102 and dropped as collected toner into the cleaning container 28. As illustrated in FIG. 19, the collected toner dropped into the cleaning container 28 is conveyed by a conveyance screw 36 (see FIG. 20) arranged along the longitudinal side of the intermediate transfer belt cleaner 102 toward an apparatus body front side Fr illustrated in FIG. 19 and is discharged through a toner outlet 28*b* (see FIG. 24B).

Then, as illustrated in FIG. 20, the collected toner discharged from the toner outlet 28*b* is contained in a collection container 37 (see FIGS. 23A and 23B) attached to the apparatus body through a path portion 33 formed from a first path member 34 and a second path member 35. The collection container 37 has a cylindrical portion 35*d* (see FIG. 24B) into which a nozzle portion 34*c* is inserted through an opening 37*a* such that the nozzle portion 34*c* and the cylindrical portion 35*d* overlap in a non-contact state in the height direction.

The path portion 33 is detachably attachable to the cleaning container 28 of the intermediate transfer belt cleaner 102 to collect the toner from the cleaning container 28. The first path member 34 as a path member is supported by the apparatus body when the intermediate transfer unit 200 is not attached to the apparatus body. The first path member 34 is coupled to the cleaning container 28 when the intermediate transfer unit 200 is attached to the apparatus body. The coupled first path member 34 becomes swingable together with the steering portion 210 including the cleaning container 28, and allows the toner outlet 28*b* to communicate with the opening 37*a* to guide the toner from the cleaning container 28 to the collection container 37 through the second path member 35 (see FIGS. 24A and 24B).

Figure 21A:
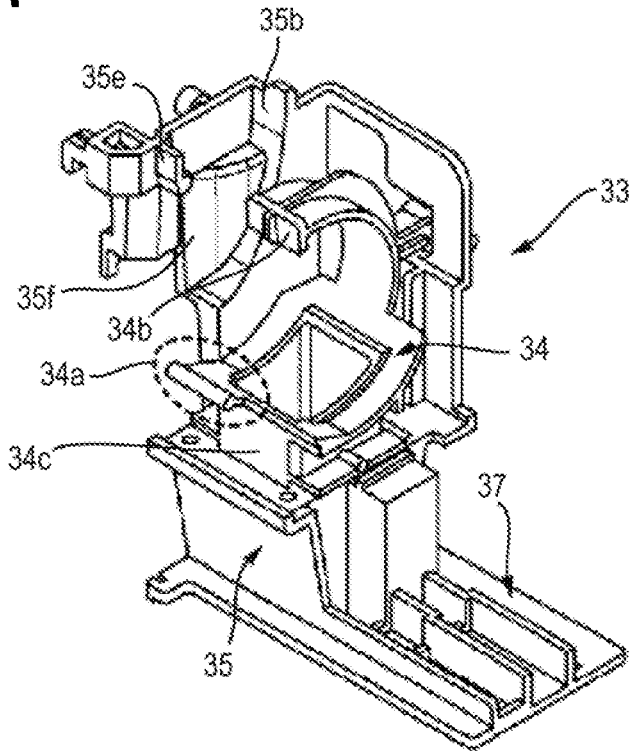
FIG. 21A is a perspective overall view of a path portion in Example 3.
Figure 21B:
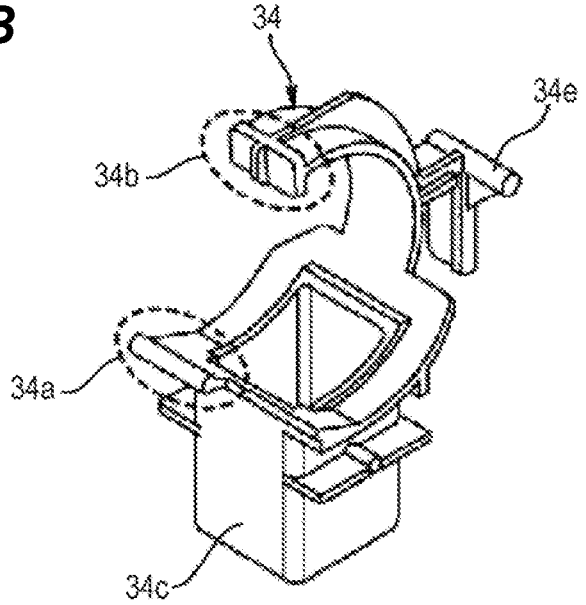
FIG. 21B is a perspective view of a first path member in the path portion in Example 3.
Figure 22:
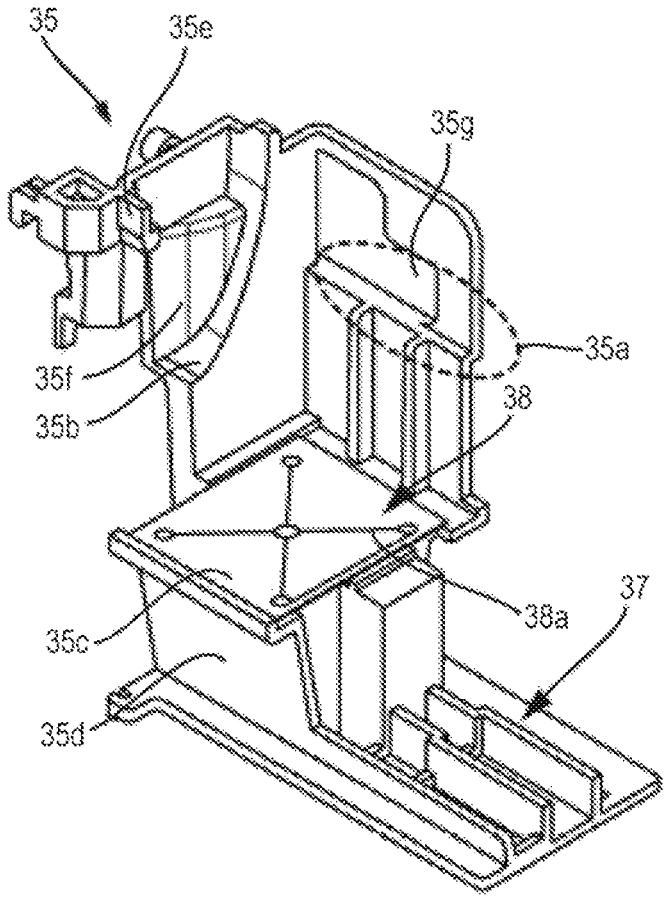
FIG. 22 is a perspective view of a second path member in the path portion in Example 3.
Figure 23A:
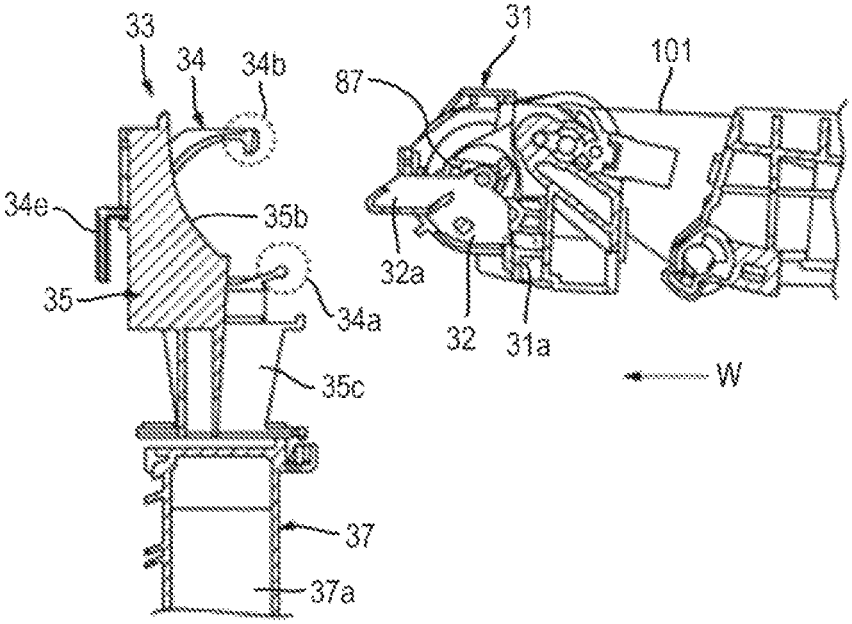
FIGS. 23A and 23B are cross-sectional views of the intermediate transfer belt unit before being set to an apparatus body.
Figure 23B:
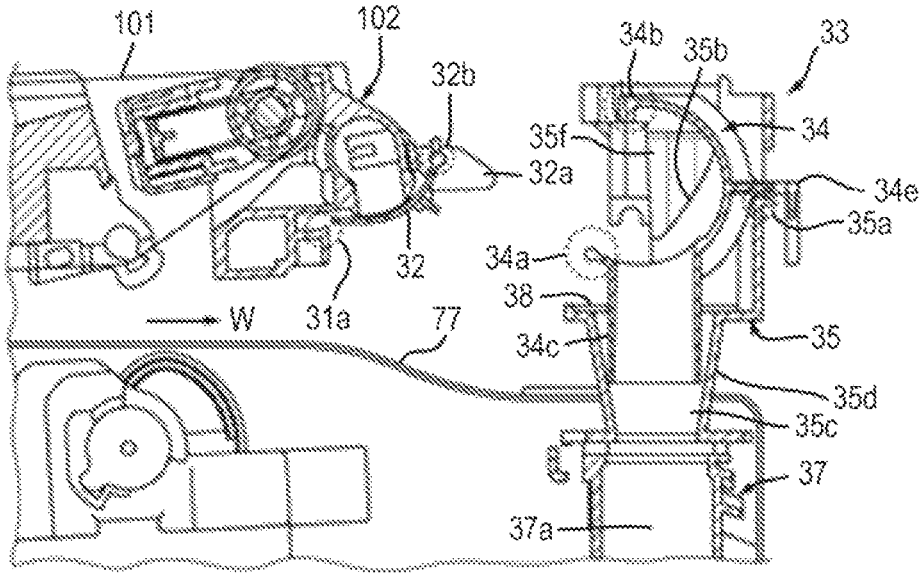
Figure 24A:
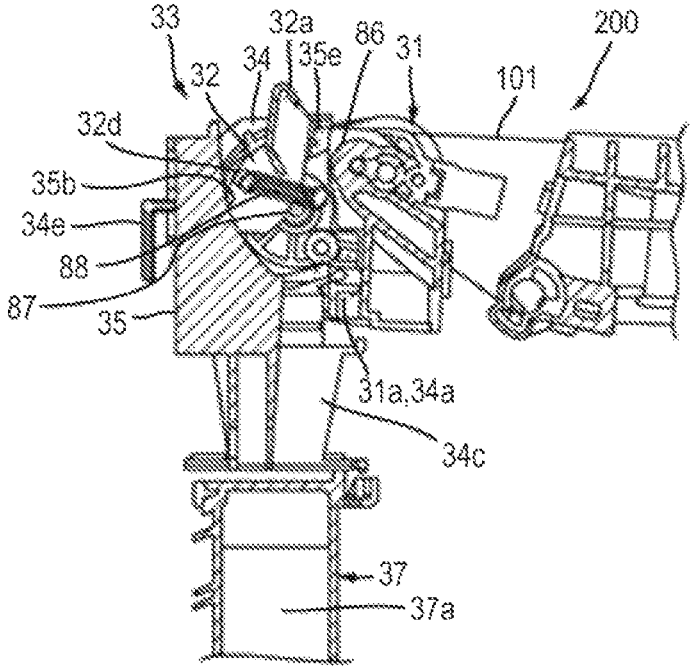
FIGS. 24A and 24B are cross-sectional views of the intermediate transfer belt unit after being set to the apparatus body.
Figure 24B:
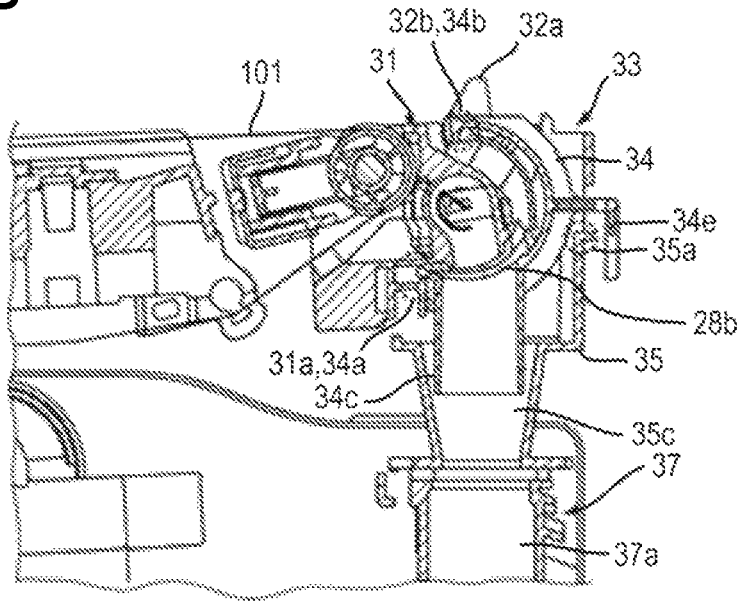

Next, a configuration of the path portion 33 will be described in detail with reference to FIGS. 21 to 24. FIG. 21A is a perspective view of the entire path portion 33 in Example 3, and FIG. 21B is a perspective view of the first path member 34 in the path portion 33 in Example 3. FIG. 22 is a perspective view of the second path member 35 in the path portion 33 in Example 3. FIG. 23A is a cross-sectional view of the intermediate transfer unit 200 that is being inserted into the apparatus body 100 as seen from the Fr side of FIG. 19, and FIG. 23B is a cross-sectional view of FIG. 23A as seen from the opposite Rr side. FIG. 24A is a cross-sectional view of the intermediate transfer unit 200 completely set to the apparatus body 100, and FIG. 24B is a cross-sectional view of FIG. 24A as seen from the opposite side.

As illustrated in FIG. 21A, the path portion 33 includes the first path member 34 and the second path member 35 that is fixed to the apparatus body to couple to and communicate with the collection container 37. The path portion 33 further has a toggle coil spring 88 (see FIG. 24A) that switches the rotation direction depending on the positional relationship with a rotation center 87 (see FIG. 23A) of the shutter member 32 to shift the shutter member 32 to the open position or the closed position. The toggle coil spring 88 has one end locked with a projection 86 on the intermediate transfer unit 200 and the other end locked with a projection 32*d* on the shutter member 32 as illustrated in FIG. 24A.

As illustrated in FIGS. 23A and 23B, the shutter member 32 has a lever portion 32*a* as an abutment portion and a shutter engagement portion 32*b*. When the intermediate transfer belt cleaner 102 is coupled to the path portion 33, the lever portion 32*a* is slid on a lever abutment portion 35*b* and a shutter abutment portion 35*f* (also see FIG. 21A) of the second path member 35 and rotated. The lever abutment portion 35*b* constitutes an abutted portion that moves the shutter member 32 while the lever portion (abutting portion)

Figure 25A:
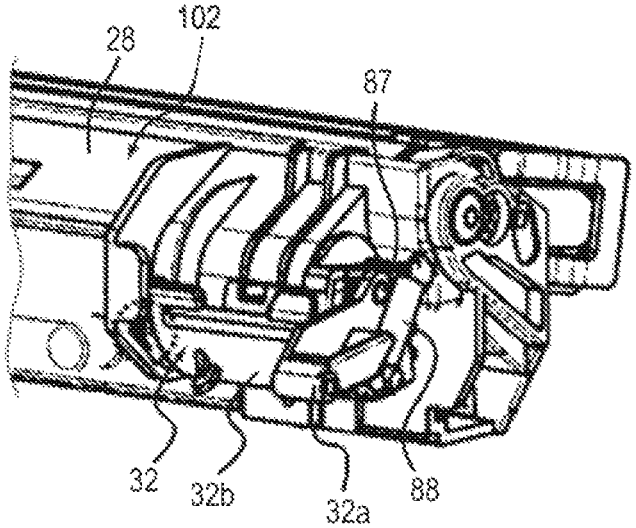
FIGS. 25A and 25B are perspective views of the intermediate transfer belt unit in the process of being set to the apparatus body.
Figure 25B:
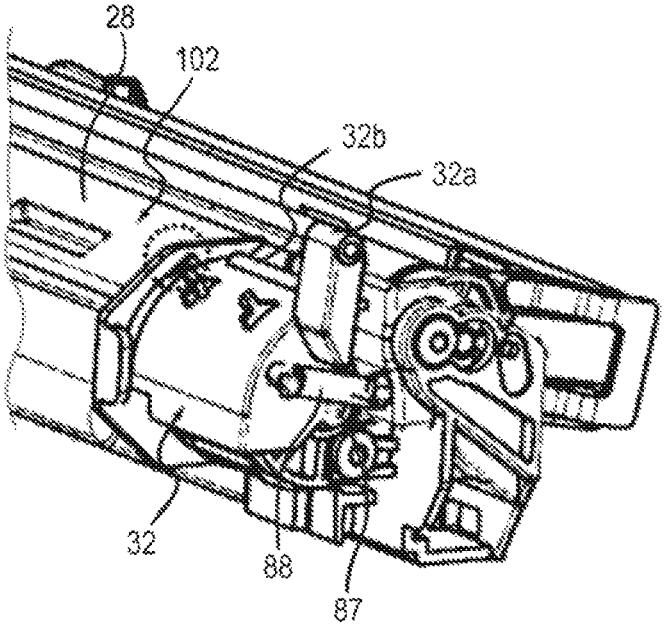

32*a* abuts with the lever abutment portion 35*b* in cooperation with the attachment of the intermediate transfer unit 200 to the image forming apparatus 100. The second path member 35 has an engagement portion 35*e* (also see FIG. 22) that engages with the rotated lever portion 32*a* as illustrated in FIG. 24A to regulate further rotation. When the intermediate transfer belt cleaner 102 is separated from the path portion 33, the engagement portion 35*e* engages with the leading end of the lever portion (abutting portion) 32*a* and rotates the lever portion 32*a* in the counterclockwise direction in FIG. 25A (the direction of closing the shutter member 32). FIGS. 25A and 25B are perspective views of the intermediate transfer belt unit that is being set to the apparatus body. FIG. 25A illustrates the state with the closed shutter member 32, and FIG. 25B illustrates the state with the opened shutter member 32.

As illustrated in FIGS. 21A and 21B, the first path member 34 has an engagement portion 34*a* for engagement with the intermediate transfer belt cleaner 102, a fixed hook portion 34*b*, and a nozzle portion 34*c* that communicates with the toner outlet 28*b* (see FIG. 24B). The first path member 34 is fixed and supported on the intermediate transfer belt cleaner 102 side by sandwiching the corresponding portions (31*a* and 32*b*) of the intermediate transfer belt cleaner 102 between the engagement portion 34*a* and the fixed hook portion 34*b*. Accordingly, the first path member 34 operates following the steering operation of the steering portion 210.

When being not engaged with the intermediate transfer belt cleaner 102, the first path member 34 has an engagement hook portion 34*e* that protrudes in a hook form toward the rear side of the curved shape portion and enters an opening portion 35*g* on the top of a posture holding convex portion 35*a* (see FIG. 22) of the second path member 35 for temporary engagement. Then, the engagement hook portion 34*e* abuts with a posture holding convex portion (predetermined portion) 35*a* of the apparatus body and is tentatively held. After the attachment of the intermediate transfer unit 200 to the image forming apparatus 100, the first path member 34 is coupled to the cleaning container 28 and is separated from the posture holding convex portion 35*a*, and becomes movable together with the steering portion 210.

As illustrated in FIG. 22, the second path member 35 has the cylindrical portion 35*d* as well as the posture holding convex portion 35*a*, the lever abutment portion 35*b*, the engagement portion 35*e*, the shutter abutment portion 35*f*, and the opening portion 35*g* described above. The cylindrical portion 35*d* has a flexible sheet material 38 as a sealing member that prevents the dispersion of the collected toner from the toner outlet 28*b* between a toner inlet 35*c* and the nozzle portion 34*c* inserted into the toner inlet 35*c*. The sheet material 38 is rectangular in shape and has two diagonal slashes 38*a*. When the sheet material 38 is placed as illustrated in FIG. 22, the toner outlet 28*b* can be inserted into the toner inlet 35*c* via the slashes 38*a*. Due to the presence of the sheet material 38, it is possible to prevent the dispersion of the toner discharged from the toner outlet 28*b* to the opening 37*a* between the opening 37*a* and the toner outlet 28*b*.

At that time, the first path member 34 abuts with the posture holding convex portion 35*a* and is supported in the state in which its tilt toward the rear side is regulated. Accordingly, it is possible to prevent the first path member 34 from being tilted in the direction of separating from the intermediate transfer unit 200 (the direction of arrow W) to cause a failure of connection with the intermediate transfer belt cleaner 102.

However, in the foregoing configuration, when the intermediate transfer belt unit is not attached, the first path member 34 should not regulate the alignment operation of the steering unit. Thus, when the intermediate transfer belt unit is not attached, the position of the first path member 34 held by the posture holding convex portion 35*a* falls in the lower end of the alignment range of the steering portion 210. Therefore, as described above, while the guide projection 215 of the steering portion 210 is released from the second guide groove 162*b* at the position C of the second guide groove 162*b* and then the second support portion 180 (see FIG. 14) supports tiltably the steering portion 210, if the front side Fr (see FIG. 19) of the apparatus body with the shutter member 32 of the intermediate transfer belt cleaner 102 is substantially tilted upward, the shutter engagement portion 32*b* retracts above the fixed hook portion 34*b* and cannot lift the fixed hook portion 34*b*. Consequently, the opening 37*a* and the toner outlet 28*b* cannot communicate with each other, which leads to the dispersion of the collected toner and the breakage of the apparatus.

Figure 26A:
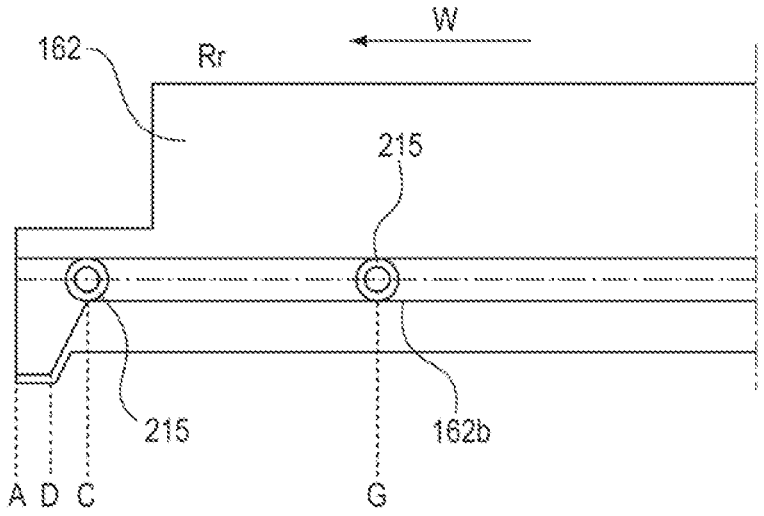
FIG. 26A is an illustrative diagram of a guide rail on the rear side of the apparatus body in Example 3.
Figure 26B:
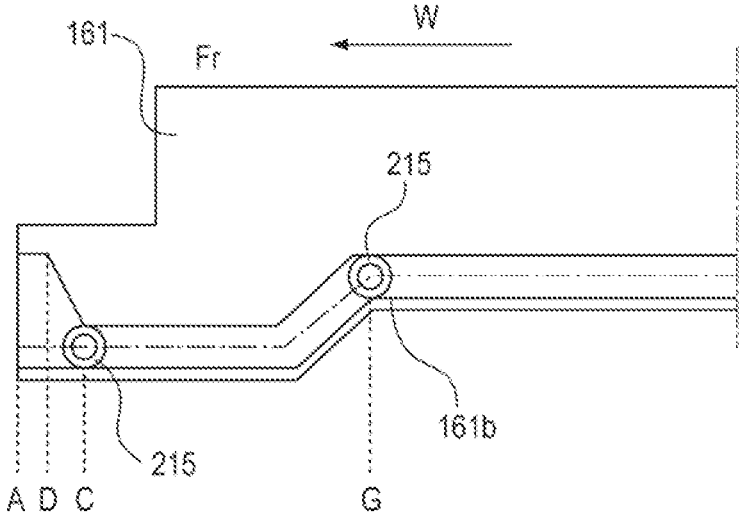
FIG. 26B is an illustrative diagram of a guide rail on the front side of the apparatus body in Example 3.

Accordingly, in Example 3, the guide groove (second guiding portion) 162*b* of the guide rail 162 on the rear side of the apparatus body and the guide groove (second guiding portion) 161*b* of the guide rail 161 on the front side of the apparatus body are respectively configured as illustrated in FIGS. 26A and 26B. FIG. 26A is an illustrative diagram of the guide rail on the rear side of the apparatus body in Example 3, which illustrates schematically the guide rail 162 with the guide groove 162*b*. FIG. 26B is an illustrative diagram of the guide rail on the front side of the apparatus body, which illustrates schematically the guide rail 161 with the guide groove 161*b*.

The guide rail 161 illustrated in FIG. 26B is provided on one side of the apparatus body 100 illustrated in FIG. 8, as seen from the axial line direction of the steering roller 112 (the direction of the axial line 112*a* illustrated in FIG. 3). The guide rail 162 illustrated in FIG. 26A is opposed to the guide rail 161 and provided on the side of the apparatus body 100 opposite to the one side illustrated in FIG. 8 as seen from the axial line direction of the steering roller 112. The other side of the apparatus body 100 with the guide rail 162 refers to the rear side Rr of the apparatus body with the drive unit 170 as illustrated in FIG. 8. The one side of the apparatus body 100 with the guide rail 161 refers to the side with the path portion 33 including the first path member 34 and the front side Fr of the apparatus body opposite to the rear side Rr of the apparatus body with the drive unit 170.

The guide groove 161*b* on the one side (the front side Fr of the apparatus body) illustrated in FIG. 26B has a range in which the steering portion 210 is tilted and lowered as compared with the guide groove 162*b* on the other side illustrated in FIG. 26A, in the process of attaching the intermediate transfer unit 200 to the apparatus body 100. In this case, the range in which the guide groove 161*b* tilts the steering portion 210 is set from a position G where the steering portion 210 passes over the image forming portions 109 to the position C where the guide projection 215 is released in front of the attachment position (attachment completion position) A.

As illustrated in FIG. 26B, the guide groove 161*b* of the guide rail 161 on the front side Fr of the apparatus body changes the position of the guide projection 215 with respect to the guide groove 162*b* on the rear side Rr of the apparatus body downward in the height direction from the position G where the steering portion 210 has passed over the image forming portions 109. At that time, as illustrated in FIG. 26A, the guide groove 162*b* of the guide rail 162 on the rear side Rr of the apparatus body does not change the position of the guide projection 215 in the height direction even when the steering portion 210 has passed the position G over the image forming portions 109. This causes the guide projection 215 on the front side Fr of the apparatus body to be lowered in the height direction as compared with the guide projection 215 on the rear side Rr of the apparatus body. As illustrated in FIG. 26B, the guide groove 161*b* of the guide rail 161 on the front side Fr of the apparatus body regulates the position of the guide projection 215 such that the tilt of the steering portion 210 falls in the lower end of the alignment range at the position C. Since the tilted posture of the steering portion 210 is maintained due to its own weight, the steering portion 210 can engage reliably with the first path member 34 even when the steering portion 210 is in a freely tiltable position. Accordingly, when the second support portion 180 (see FIG. 14) supports tiltably the steering portion 210, it is possible to prevent non-communication between the opening 37*a* and the toner outlet 28*b* that would lead to the dispersion of the collected toner and the breakage of the apparatus.

OTHER EXAMPLES

In the foregoing examples, the four image forming portions of different colors are used. However, the colors and the number of image forming portions are not limited but can be set as appropriate.

In the foregoing examples, a printer is taken as image forming apparatus. However, the present invention is not limited to this. For example, the present invention may be another image forming apparatus such as a facsimile machine or a copying machine, or a complex machine with a combination of these functions. In addition, the intermediate transfer unit having the intermediate transfer belt is taken as an example of a belt conveyance device detachably attachable to the image forming apparatus. However, the present invention is not limited to this but may be a conveyance unit including a conveyance belt that conveys a transfer material. The same advantageous effects can be achieved by applying the present invention to image forming apparatuses including these belt conveyance devices in a detachably attachable manner.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-064227, filed Mar. 29, 2017, and No. 2018-026932, filed Feb. 19, 2018, which are hereby incorporated by reference herein in their entirety.

What is claimed is:

1. An image forming apparatus comprising:

a belt unit having an intermediate transfer belt and configured to be detachably attachable to a main body of the image forming apparatus in an insertion direction of the belt unit, which intersects a width direction of the intermediate transfer belt, through an opening portion disposed at a side face of the image forming apparatus, wherein the belt unit has a first roller supporting the intermediate transfer belt, a frame rotatably supporting the first roller, and a steering unit supported to be tiltable with respect to the frame and having a second roller supporting the intermediate transfer belt, the steering unit, in a case that the intermediate transfer belt moves to one side in the width direction thereof while the intermediate transfer belt rotates, being configured to tilt the second roller so that the intermediate transfer belt moves toward the other side thereof;

a pair of first guided portions disposed at both ends of the frame with respect to the width direction of the intermediate transfer belt;

a first guide portion disposed on the main body of the image forming apparatus and configured to support the pair of first guided portions when the belt unit is attached and to guide the frame;

a pair of second guided portions disposed at both ends of the steering unit with respect to the width direction of the intermediate transfer belt;

a second guide portion disposed on the main body of the image forming apparatus and configured to support the pair of the second guided portions when the belt unit is attached and to guide the steering unit, wherein the second guide portion releases support of the steering unit when the belt unit is positioned at an attached position.

2. The image forming apparatus according to claim 1, wherein the pair of second guided portions comprises projecting portions which project from sides of the steering unit and the second guide portion has guide grooves configured to regulate movement of the projecting portions so as to regulate movement of the steering unit in an up and down direction.

3. The image forming apparatus according to claim 1, further comprising a supporting portion provided on the main body of the image forming apparatus and supporting a center portion of the steering unit with respect to the width direction of the intermediate transfer belt when the belt unit is set in the attached position, the supporting portion being configured to support the steering unit while the steering unit is guided by the second guide portion.

4. The image forming apparatus according to claim 1, further comprising a cleaning unit disposed on the steering unit and configured to clean toner remaining on the intermediate transfer belt.

5. The image forming apparatus according to claim 4, further comprising:

a collection container disposed in the main body of the image forming apparatus and configured to collect waste toner from the cleaning unit, and a path portion disposed at one side of the intermediate transfer belt with respect to the width direction of the intermediate transfer belt and supported by the main body of the image forming apparatus in a case that the belt unit is not attached, the path portion being connectable to the cleaning unit to form a discharge route of the waste toner between the cleaning unit and the collection container, wherein the second guide portion guides the steering unit so that the one side of the intermediate transfer belt is lower than the other side thereof before the path portion connects to the cleaning unit.

6. The image forming apparatus according to claim 1, wherein the second guide portion is configured to restrict and support both ends of the steering unit.

7. The image forming apparatus according to claim 1, wherein the steering unit comprises the second roller disposed so to abut to an inner side of the intermediate transfer belt and rotate with the intermediate transfer belt, a friction portion disposed respectively on both outer sides of the second roller with respect to a rotary axis direction of the second roller and configured to slide relative to the inner side of the intermediate transfer belt and a supporting portion supporting the second roller and the friction portion and configured to rotate the second roller and the friction portion as one body around an axis crossing the rotary axis direction, and the supporting portion is configured to tilt so as to steer the intermediate transfer belt with sliding between the intermediate transfer belt and the friction portion.

* * * * *